US008172733B1

(12) United States Patent
Batca

(10) Patent No.: US 8,172,733 B1
(45) Date of Patent: May 8, 2012

(54) LINEARLY ADJUSTABLE MULTI RESISTANCE RATIO EXERCISE APPARATUS

(76) Inventor: Roger Batca, Durham, NC (US)

( * ) Notice: Subject to any disclaimer, the term of this patent is extended or adjusted under 35 U.S.C. 154(b) by 0 days.

(21) Appl. No.: 12/695,234

(22) Filed: Jan. 28, 2010

Related U.S. Application Data

(63) Continuation-in-part of application No. 12/046,034, filed on Mar. 11, 2008, now Pat. No. 7,654,942, and a continuation-in-part of application No. 12/685,975, filed on Jan. 12, 2010, now abandoned, which is a continuation of application No. 12/046,034.

(60) Provisional application No. 60/918,391, filed on Mar. 16, 2007.

(51) Int. Cl.
*A63B 21/062* (2006.01)
*A63B 21/06* (2006.01)

(52) U.S. Cl. ..... 482/99; 482/93

(58) Field of Classification Search ..... 482/92, 482/93, 97–102, 133–138
See application file for complete search history.

(56) References Cited

U.S. PATENT DOCUMENTS 4,603,855 A * 8/1986 Sebelle ..... 482/103
6,394,935 B1 * 5/2002 Lake ..... 482/94
6,447,430 B1 * 9/2002 Webb et al. ..... 482/98
6,527,683 B2 * 3/2003 Tolles ..... 482/99
6,565,490 B2 * 5/2003 O'Hearn ..... 482/102
7,070,546 B1 * 7/2006 Grasso ..... 482/103
7,172,538 B2 * 2/2007 Keiser ..... 482/140
7,654,942 B1 * 2/2010 Batca ..... 482/99

OTHER PUBLICATIONS

U.S. Appl. No. 12/019,174, filed Jan. 24, 2008.

* cited by examiner

*Primary Examiner* — Allana Lewin
(74) *Attorney, Agent, or Firm* — Coats & Bennett, P.L.L.C.

(57) ABSTRACT

A linearly adjustable multi resistance ratio exercise apparatus provides at least two linearly adjustable flexible connector ends which can be pressed or pulled for functional and strength training exercises. The flexible connector ends may be interconnected with resistance wherein the pressing or pulling of one flexible connector end will provide the user a different ratio of resistance than the pressing or pulling of an alternate flexible connector end. The user can select a flexible connector end which will provide less resistance and will provide more flexible connector travel for functional training exercises. The user can select a flexible connector end which will provide more resistance and will provide less flexible connector travel for strength training exercises. Some flexible connector ends may share the same swivel pulley assembly. One handle assembly may be attached to multiple flexible connector ends to obtain additional ratios of resistance.

19 Claims, 28 Drawing Sheets

LINEARLY ADJUSTABLE MULTI RESISTANCE RATIO EXERCISE APPARATUS

RELATED APPLICATIONS

This application is a continuation-in-part (CIP) of U.S. patent application Ser. No. 12/046,034 filed Mar. 11, 2008, issued as U.S. Pat. No. 7,654,942, which claims priority to Provisional Patent Application No. 60/918,391 filed Mar. 16, 2007, both of which are incorporated herein by reference. This application is also a continuation-in-part (CIP) of U.S. patent application Ser. No. 12/685,975 filed on Jan. 12, 2010, which is now abandoned. This application is also a continuation of U.S. patent application Ser. No. 12/046,034 filed Mar. 11, 2008 which claims priority to Provisional Application No. 60/918,391 filed Mar. 16, 2007, which are incorporated herein by reference.

FIELD OF THE INVENTION

The present invention is directed generally to exercise equipment and, more particularly, an apparatus to perform user defined movements by pressing or pulling one or more handles connected to one or more linearly adjustable cable or flexible connector ends.

BACKGROUND

Exercising is well known as a basic need for maintaining a healthy life. A recent trend in fitness is known as functional training. This type of training allows an individual to grasp one or more handles of an exercise machine and press or pull in a motion defined by the user. This motion can reproduce sport specific movements of an athlete or reproduce everyday movements of an individual. User defined movements with resistance will engage numerous stabilizer and major muscles and help an individual achieve total body strength conditioning and overall better health.

One type of exercise machine used to perform functional training is an adjustable cable column. Typically, an adjustable cable column has a cable end with a handle assembly attached which can be pressed or pulled by a user. The cable end exits a swivel pulley assembly that is pivotally attached to a sleeve. This sleeve is linearly adjustable along a column enabling a user to engage a handle assembly at different starting positions for different exercises. The pivotally attached swivel pulley on the linearly adjustable sleeve allows the handle assembly to be pressed or pulled in multiple planes thus accommodating different sized users with different flexibilities and different training goals.

Typically, a weight stack provides the resistance for these adjustable cable columns. In order for the cable to maintain constant tension during the linear adjustment of a cable end along with a handle assembly, the cable is formed into a loop wherein each end of the cable is directed towards the linearly adjustable sleeve from opposite directions. One end of the cable is routed over at least one pulley on a swivel pulley assembly which is pivotally attached to a sleeve as previously described. The other end of the cable is also either tied into the same linearly adjustable sleeve or either routed over a second swivel pulley assembly which is pivotally attached to the same linearly adjustable sleeve. This same cable is also routed around one or two pulleys on top of the weight stack. When one or both ends of the cable assembly is pressed or pulled, the closed loop shortens, therefore lifting the selected weights in the weight stack and therefore providing resistance to the user.

The cable end of some adjustable cable columns are interconnected with the weight stack wherein a 4 to 1 mechanical advantage is provided to the user when one cable end is pressed or pulled. For example, if the adjustable cable column has a 200 lb weight stack and all 200 lbs are selected, pressing or pulling one cable end will provide 50 lbs of resistance. This is an advantage because the cable end can be pressed or pulled a long distance before the top of the weight stack will run out of upward travel distance. This allows the user to perform many functional training exercises that require long distance pressing or pulling and light weight resistance. This is a disadvantage if the user wants to perform strength training exercises that require shorter distance pressing or pulling and heavier weight resistance. An adjustable cable column could be made with a heavier weight stack such as 400 lbs but this would greatly increase the cost of the exercise machine.

The cable end of some adjustable cable columns are interconnected with the weight stack wherein a 2 to 1 mechanical advantage is provided to the user when one cable end is pressed or pulled. For example, if the adjustable cable column has a 200 lb weight stack and all 200 lbs are selected, pressing or pulling one cable end will provide 100 lbs of resistance. This 2 to 1 mechanical advantage does not allow as much cable end travel as the 4 to 1 mechanical advantage does because of the exercise machine height restrictions of the upward travel of the weight stack. The 2 to 1 ratio is an advantage if the user wants to perform strength training exercises that require shorter distance pressing or pulling and heavier weight resistance. The 2 to 1 ratio is a disadvantage if the user wants to perform some functional training exercises that require long distance pressing or pulling and light weight resistance.

Two adjustable cable columns can be combined into one exercise apparatus known as a cable crossover wherein the two columns are spaced apart from one another and the user can grasp two separate handle assemblies on two separate columns. This cable crossover typically has one or two weight stacks to provide resistance.

Having a separate adjustable cable column and/or cable crossover for lighter weight functional training and a separate adjustable cable column and/or cable crossover for heavier weight strength training would be to costly and require too much room to house the equipment. Also, manufacturing an exercise machine that is too tall to allow more cable travel is not practical because of height restrictions. Thus, there is a need for an exercise machine with linearly adjustable handle assemblies that will provide alternate resistance ratios for light weight functional training and heavier weight strength training.

SUMMARY

The present invention is directed to a linearly adjustable flexible connector end exercise apparatus that includes one flexible connecting system that provides multiple resistance ratios for functional and strength training. The exercise apparatus comprises a frame, a resistance element, and a flexible connecting system which includes at least two linearly adjustable flexible connector ends which can be pressed or pulled by a user. A handle or other attachment can be connected to one or more of the flexible connector ends. The flexible connecting system connects the resistance element to the handle or other attachment. In one exemplary embodiment, the resistance element is a weight stack and the flexible connecting system is a cable system.

In one exemplary embodiment, one cable system includes two or more closed cable loops, wherein the ends of two or more closed cable loops are linearly adjustable and interconnected with resistance wherein the pressing or pulling of one end of one closed cable loop will provide a different ratio of resistance than the pressing or pulling of one end of an alternate closed cable loop. For example, one closed cable loop is interconnected with resistance wherein the pressing or pulling of one end of this closed cable loop will provide a 4 to 1 mechanical advantage to the user. A second closed cable loop is interconnected with resistance wherein the pressing or pulling of one end of this closed cable loop will provide a 2 to 1 mechanical advantage to the user. Additional closed cable loops could be included in the cable system wherein the pressing or pulling of one end of each additional closed cable loop could provide other alternate resistance ratios.

In one embodiment, the ends of two or more closed cable loops are linearly adjustable independently on respective tracks with respective carriage assemblies which include a respective sleeve assembly and a respective swivel pulley assembly. In an alternate embodiment, the ends of two or more closed cable loops are linearly adjustable simultaneously on one track with one carriage assembly which includes one sleeve assembly and multiple respective swivel pulley assemblies.

In another aspect of the invention, the ends of two or more closed cable loops are linearly adjustable simultaneously on one track with one carriage assembly which includes one sleeve assembly and one swivel pulley assembly which includes at least one pulley for a respective cable loop end and preceding cable portion to partially wrap around as it exits the linearly adjustable swivel pulley assembly during exercise. In one embodiment, each closed cable loop is interconnected with resistance wherein the pressing or pulling of a respective cable loop end will provide the user an alternate ratio of resistance as previously described. Multiple cable loop ends can also be connected to one handle to yet provide another alternate ratio of resistance. In an alternate embodiment, each closed cable loop is interconnected with resistance wherein the pressing or pulling of a respective cable loop end will provide the same ratio of resistance, however the user can connect more than one cable loop end to one handle to receive alternate resistance ratios.

In another aspect of the invention, the ends of one or more closed cable loops are linearly adjustable simultaneously on one track with one carriage assembly which includes one sleeve assembly and one swivel pulley assembly wherein both ends and preceding cable portions of each closed cable loop partially wrap around at least one respective pulley and exit the linearly adjustable swivel pulley assembly during exercise.

Other aspects of the invention will become apparent in the detailed description.

DETAILED DESCRIPTION

Figure 1:
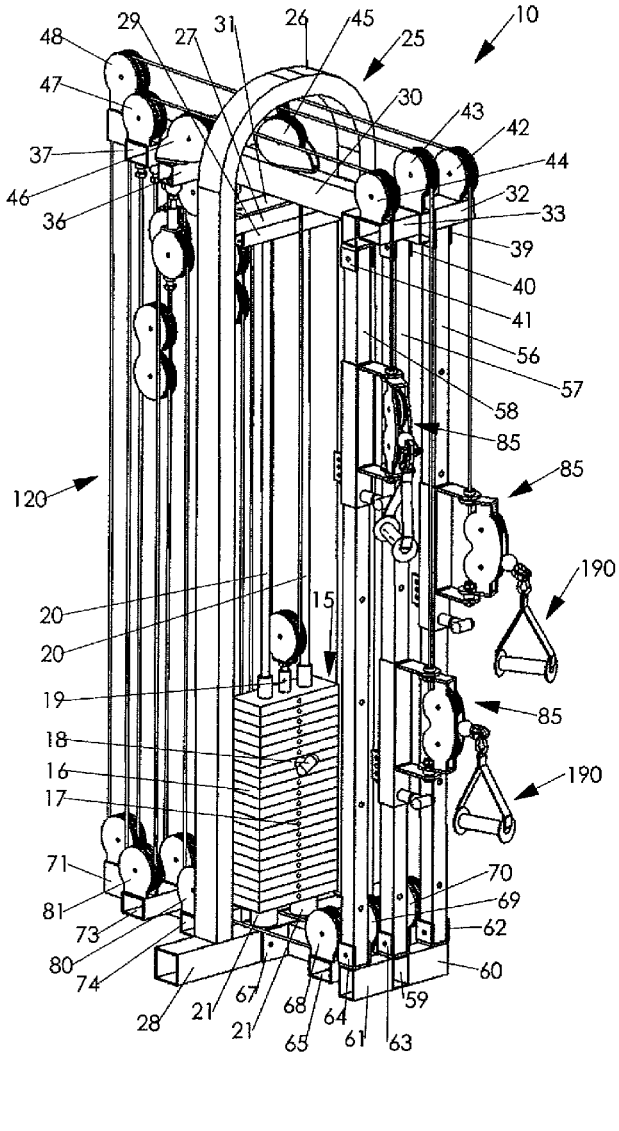
FIG. 1 is a perspective view illustrating an exemplary linearly adjustable multi resistance ratio exercise apparatus according to the present invention from the front right side.

The embodiments illustrated in the drawings is for an exercise apparatus which includes at least one flexible connecting system which includes at least two linearly adjustable flexible connector ends. A handle assembly can be connected to one or more of the flexible connector ends. Each flexible connector end may be interconnected with resistance wherein the pressing or pulling of a respective end will provide an alternate ratio of resistance to the user. The user can press or pull the desired flexible end or ends based on whether they need lighter resistance and more flexible connector travel for functional training movements or heavier resistance and less flexible connector travel for strength training movements.

Referring now to the drawings, one exemplary and five alternate embodiments of a linearly adjustable multi resistance ratio exercise apparatus according to the present invention will be described and indicated generally by the numerals 10, 210, 410, 610, 1210, and 1410. Each above mentioned embodiment comprises a resistance element and will be described and indicated generally be the numeral 15. A linearly adjustable multi resistance ratio exercise apparatus 10, 210, 410, 610, 1210, and 1410 also comprises a frame 25, 225, 425, 625, 1225, and 1425, and at least one linearly adjustable carriage assembly 85, 285, 485, and 685, and a flexible connecting system 120, 320, 520, 720, 1320, and 1520 interconnecting at least one handle assembly 190 to the resistance element 15.

The resistance element 15 provides resistance to the force applied when one or more flexible connector ends are pressed or pulled. A weight stack 15 will be described as providing the resistance in the exemplary and alternate embodiments of the linearly adjustable multi resistance ratio exercise apparatus 10, 210, 410, 610, 1210, and 1410. As illustrated in FIG. 1, the weight stack 15 includes a number of individual weight plates 16 that can be selectively added to and removed from the load picked up by the user to provide variable amounts of resistance. Guide rods 20 extend through apertures in each of the plates 16 and through bumpers 21 which the weight stack 15 rests on. The selected plates 16 slide vertically along the guide rods 20 as the user exercises. A lifting rod 19 includes a series of apertures (not shown) that align with corresponding apertures 17 in the weight plates 16. The user selects the desired number of plates 16 to be lifted by inserting a pin 18 through the aperture 17 in a selected plate 16 and engages the pin 18 with the aperture in the lifting rod 19. Those skilled in the art will appreciate that other resistance devices, such as electronic resistance devices, magnetic breaks, hydraulic cylinders, elastic bands, free weights or pneumatic resistance may also be used to practice the present invention.

Figure 21:
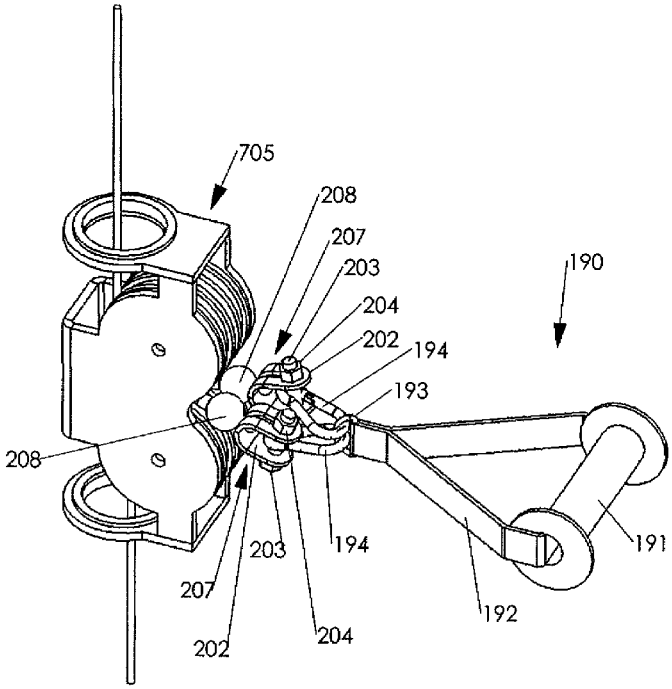
FIG. 21 is a perspective view illustrating one alternate swivel pulley assembly wherein two cable ends are connected to one exemplary handle.
Figure 21:
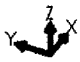
Figure 22:
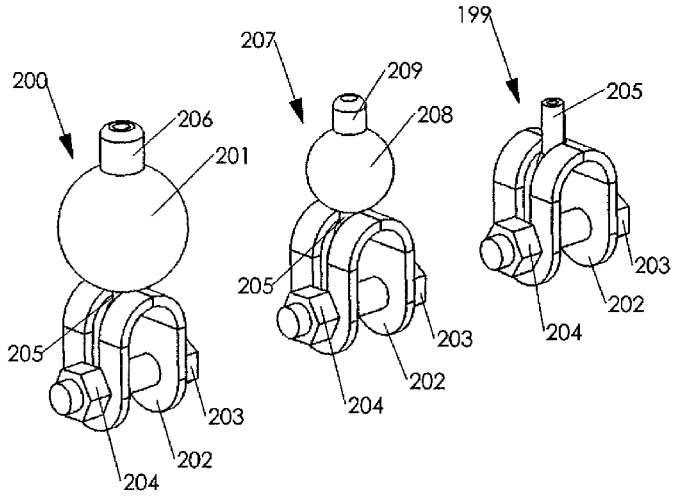
FIG. 22 is a perspective view illustrating three embodiments of cable end assemblies.
Figure 22:
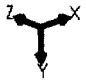

The flexible connecting system 120, 320, 520, 720, 1320, and 1520 interconnects the weight stack 15 with at least one handle assembly 190. FIG. 21 illustrates a handle assembly 190 which comprises a handle 191, a strap 192, a buckle 193, and a snap hook 194. Those skilled in the art will appreciate that there are many different types of handle assemblies not shown that can be used to practice the invention. A cable system 120, 320, 520, 720, 1320, and 1520 will be described as interconnecting the weight stack 15 with at least one handle assembly 190 in the exemplary and alternate embodiments of the linearly adjustable multi resistance ratio exercise apparatus 10, 210, 410, 610, 1210, and 1410. FIG. 22 illustrates exemplary embodiments of cable end assemblies used on the ends of closed cable loops and cable assemblies used within cable system 120, 320, 520, 720, 1320, and 1520. Cable end assembly 200 comprises large stop member 201, large stop member retainer 206, shank 205, strap 202, bolt 203, and nut 204. Cable end assembly 207 comprises small stop member 208, small stop member retainer 209, shank 205, strap 202, bolt 203, and nut 204. Cable end assembly 199 comprises shank 205, strap 202, bolt 203, and nut 204. Those skilled in the art will appreciate that other flexible connecting systems such as belts, chains, cords, or rope may be used to practice the present invention. Also, those skilled in the art will appreciate that there are many different cable end assemblies that can be used to provide a rest position for a cable end as well as attachment means for a handle assembly.

Figure 3:
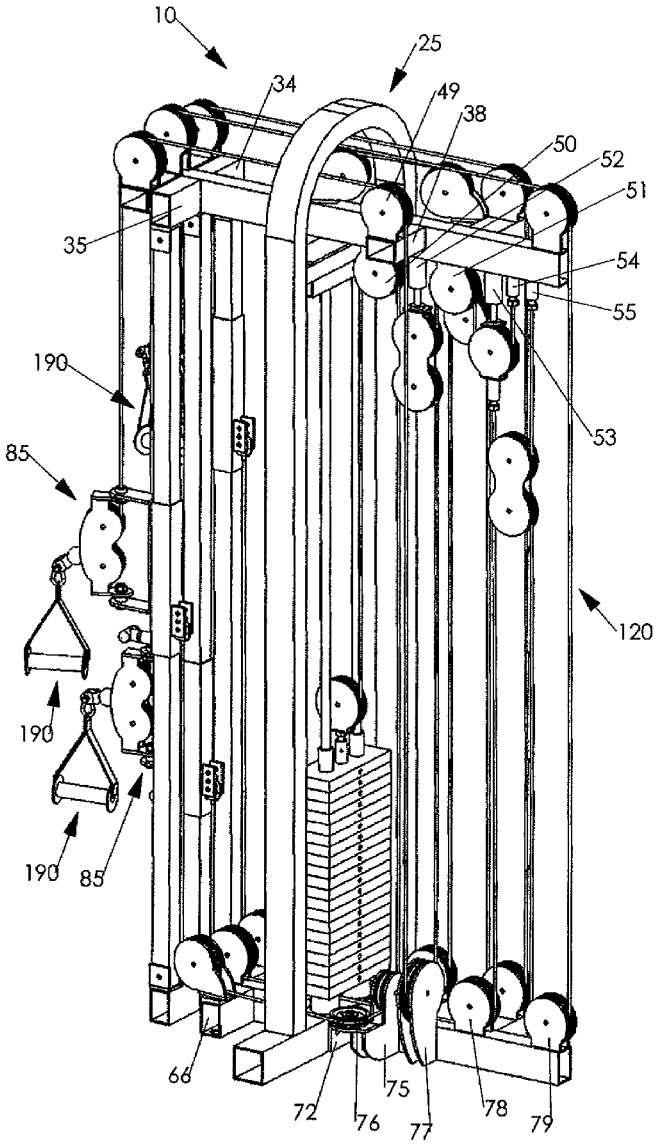
FIG. 3 is a perspective view illustrating an exemplary linearly adjustable multi resistance ratio exercise apparatus according to the present invention from the back left side.

FIGS. 1 and 3 illustrate an exemplary linearly adjustable multi resistance ratio exercise apparatus 10 which comprises a weight stack 15 to provide resistance, a frame 25 to provide structural support and stability, three linearly adjustable carriage assemblies 85, cable system 120, and three handle assemblies 190. FIG. 1 illustrates linearly adjustable multi resistance ratio exercise apparatus 10 from the front wherein three linearly adjustable carriage assemblies 85 are adjusted to alternate positions along respective columns 56, 57, and 58. FIG. 3 illustrates linearly adjustable multi resistance ratio exercise apparatus 10 from the back wherein three linearly adjustable carriage assemblies 85 are adjusted to alternate positions along respective columns 56, 57, and 58.

Figure 2:
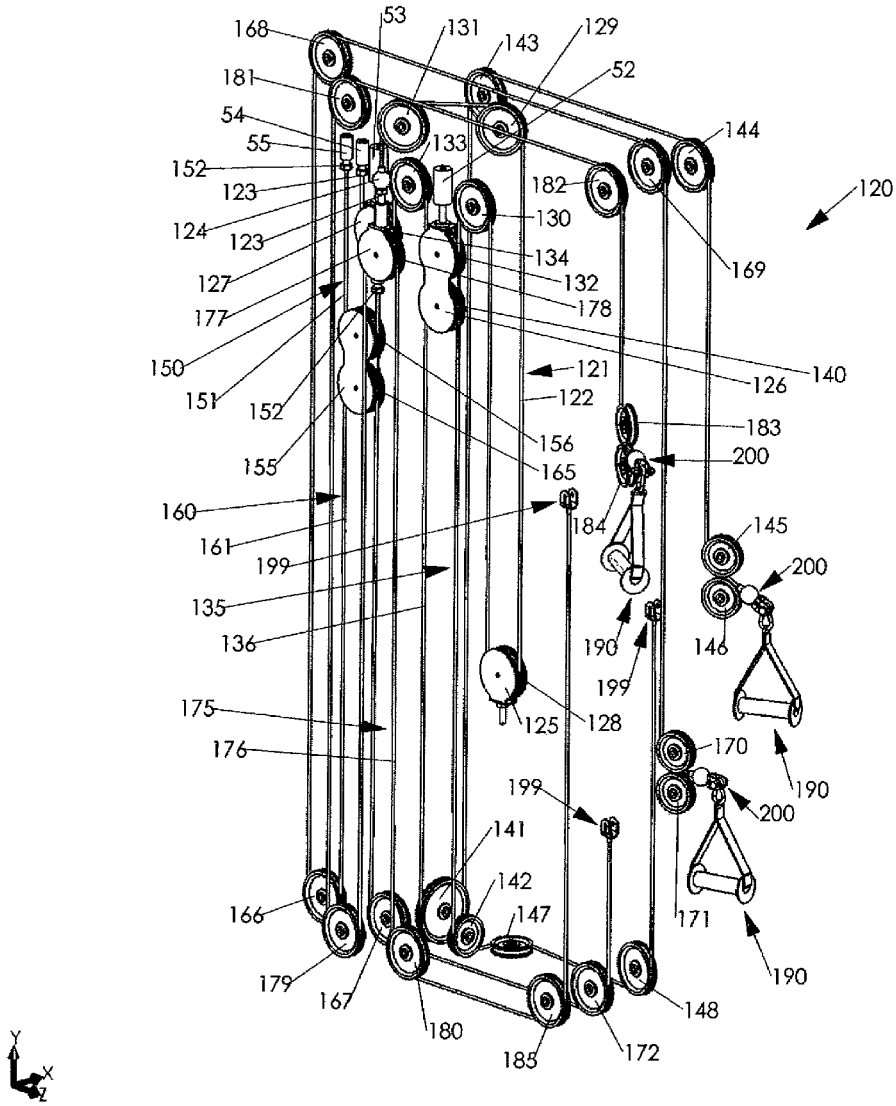
FIG. 2 is a perspective view illustrating the cable and pulley system of an exemplary linearly adjustable multi resistance ratio exercise apparatus according to the present invention from the front right side.

The frame may have a variety of configurations depending on the specific application. In one embodiment, as shown in FIGS. 1 and 3, the frame 25 includes a weight stack cage 26, which houses the weight stack 15, and sits on cage bottom 28, which secures the bottom of guide rods 20. Cross member 27 is attached to near the top of weight stack cage 26 and secures guide rod tube 29 which secures the tops of guide rods 20. A front bottom portion of the frame 25 includes front plate 67 which is attached to the front of cage bottom 28. Front bottom tube 59 is attached to front plate 67 and provides attachment points for front bottom outside tubes 60, 61, 65, and 66. Column brackets 62 and 64 are attached on top of front bottom outside tubes 60 and 61 and secure the bottoms of columns 56 and 58. Column bracket 63 is attached on top of front bottom tube 59 and secures the bottom of column 57. As also illustrated in FIG. 2, pulley plates 68 are attached on top of front bottom outside tube 65 and secure pulley 185. Pulley bracket 70 is attached on top of front bottom outside tube 66 and secures pulley 148. Pulley plates 69 are attached on top of front bottom tube 59 and secure pulley 172.

The frame 25 further includes a back bottom portion which includes back plate 72 which is attached to the back of cage bottom 28. Back bottom tube 71 is attached to back plate 72 and provides attachment points for back bottom outside tubes 73 and 74. Pulley plates 80 and 81 are attached on top of back bottom outside tubes 74 and 73 and secure pulleys 180 and 179. Pulley plates 78 and 79 are attached on top of back bottom tube 71 and secure pulleys 167 and 166. Pulley plates 75 and 77 are attached to the side of back bottom tube 71 and secure pulleys 142 and 141. Pulley plate 76 is attached on top of pulley plates 75 and secures pulley 147.

The frame 25 further includes a top portion which includes top tube 30 which is attached to top plate 31 which is secured on top of cross member 27. Top tube 30 provides attachment points for top outside tubes 32, 33, 34, 35, 36, 37, and 38. Pulley plates 42 and 44 are attached on top of top outside tubes 32 and 33 and secure pulleys 144 and 182. Pulley plates 43, pulley bracket 45, and pulley plates 48 are attached on top of top tube 30 and secure pulleys 169, 129, and 168. Pulley plates 47 and 49 are attached on top of top outside tubes 37 and 38 and secure pulleys 181 and 143. Pulley bracket 46 is attached on top of top outside tube 36 and secures pulley 131. Pulley plates 50 and 51 are attached underneath of top tube 30 and secure pulleys 130 and 133. Leveler lockout 52 is attached underneath top tube 30 and prevents double free floater 126 from upwards travel. Leveler lockout 53 is attached underneath top tube 30 and prevents single free floater 127 from upwards travel. Cable retainer 54 is attached underneath top tube 30 and secures one end of cable assembly 121. Cable retainer 55 is attached underneath top tube 30 and secures one end of cable assembly 150. Top outside tube 36 prevents stop member 124 from upwards travel. Column bracket 40 is attached underneath top tube 30 and secures the top of column 57. Column brackets 39 and 41 are attached underneath top outside tubes 35 and 34 and secure the tops of columns 56 and 58.

Figure 4:
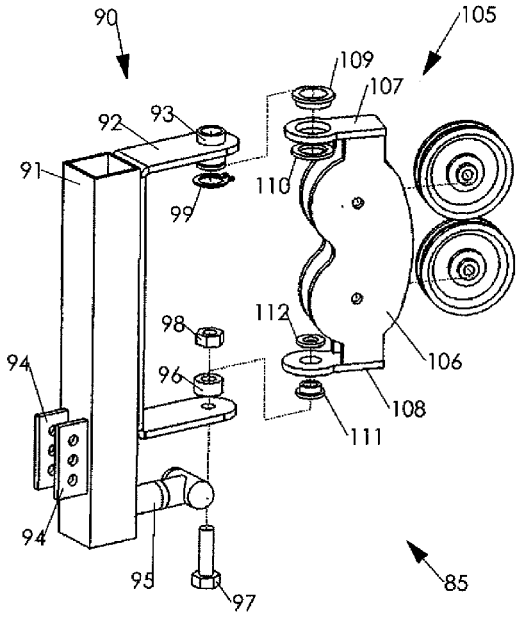
FIG. 4 is a perspective view illustrating an exemplary linearly adjustable carriage assembly.
Figure 4:
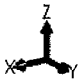

In the exemplary embodiment, the linearly adjustable multi ratio resistance exercise apparatus 10 comprises three linearly adjustable carriage assemblies 85. The present invention within this embodiment could also be made with two, four, or even more linearly adjustable carriage assemblies 85. In one embodiment, as shown in FIG. 4, a linearly adjustable carriage assembly 85 comprises a sleeve assembly 90 and a swivel pulley assembly 105.

A sleeve assembly 90 comprises sleeve 91 which forms a perimeter around a respective column 56, 57, or 58 and slidingly retains the carriage assembly 85 onto the linearly adjustable multi resistance ratio exercise apparatus 10. A bracket 92 is attached to one side of sleeve 91. Pivot sleeve 93 is attached at the top of bracket 92 and provides a pivot point for swivel pulley assembly 105. Bolt 97, spacer 96, nut 98, and retaining ring 99 secure swivel pulley assembly 105 to the sleeve assembly 90. Locking pin 95 is attached to one side of sleeve 91 and secures the carriage assembly 85 into the desired location along a respective column 56, 57, or 58. Cable tie in plates 94 secure one end of a closed cable loop within cable system 120.

A swivel pulley assembly 105 comprises pulley plates 106 which secure two pulleys. Top pivot plate 107 is attached to the top of pulley plates 106 and includes bushings 109 and 110 and pivotally attaches swivel pulley assembly 105 to sleeve assembly 90. Bottom pulley plate 108 is attached to the bottom of pulley plates 106 and includes bushings 111 and 112 and pivotally attaches swivel pulley assembly 105 to sleeve assembly 90.

In the exemplary embodiment, as illustrated in FIG. 2, cable system 120 includes cable assembly 121, cable assembly 135, cable assembly 150, cable assembly 160, cable assembly 175, weight stack pulley bracket 125, double pulley free floater 126, single pulley free floater 127, double pulley free floater 155, and single pulley free floater 177. Cable assembly 121 is directly connected with the weight stack 15 and serves as a main cable sector wherein cable assemblies 135, 150, 160, and 175 can tap into and interconnect with resistance.

Cable assembly 121 comprises cable 122 which includes stop member 124 and cable bolt 123 attached at one end and cable bolt 123 attached at the other end. Cable 122 is routed through top outside tube 36 then over fixed pulleys 131 and 129, then downward and around pulley 128 in weight stack pulley bracket 125. Cable 122 is then routed upwards and over fixed pulley 130, then downwards and around pulley 132 in double pulley free floater 126. Cable 122 is then routed upwards and around pulley 133, then downward and around pulley 134 in single pulley free floater 127. This end of cable 122 is then retained by cable retainer 54. Top outside tube 36 prohibits upward travel of the other end of cable 122 by bracing against stop member 124.

Cable assembly 135 comprises cable 136 which includes cable end assembly 200 attached at one end and cable end assembly 199 attached at the other end. Generally, the middle section of cable 136 is routed around pulley 140 in double pulley free floater 126. Respective sides of cable 136 are then routed downward and around fixed pulleys 142 and 141. After passing fixed pulley 141, this side of cable 136 is then routed upward and around fixed pulley 143, then outward and around fixed pulley 144. Cable 136 is then routed downward and around linearly adjustable pulley 145. This is where one end of cable assembly 135 exits carriage assembly 85. Cable end assembly 200 bumpers against swivel pulley assembly 105 and provides this end of cable 136 a rest position when not in use as well as an attachment point for handle assembly 190. After passing fixed pulley 142, the other side of cable 136 is then routed outward and around fixed pulley 147, then outward and around fixed pulley 148. Cable 136 is then routed upward and then tied into carriage assembly 85. Cable end assembly 199 secures this end of cable 136 into cable tie in plates 94. Both ends of cable 136 are routed towards carriage assembly 85 from opposite directions therefore closing cable 136 into a loop wherein cable assembly 135 will maintain a substantially constant tension when carriage assembly 85 is linearly adjusted into the desired position. Linearly adjustable pulley 146 serves as a guide pulley when one end of cable assembly 135 is pressed or pulled. When one end of cable assembly 135 is pressed or pulled, double pulley free floater 126 is pulled downward which causes cable assembly 121 to lift weight stack 15 therefore providing a 2 to 1 mechanical advantage to the user. Those skilled in the art will appreciate that the other end of cable 136 could also be made to exit a swivel pulley assembly for pressing or pulling by a user rather than being tied into carriage 85.

Cable assembly 150 comprises cable 151 which includes respective cable bolts 152 attached at respective ends. Cable 151 is routed around pulley 156 in double pulley free floater 155 wherein both sides of cable 151 are then routed upwards. One end is retained in single pulley free floater 127 and the other end is retained in cable retainer 55. Cable assembly 150 interconnects cable assembly 160 to the main cable sector, cable assembly 121.

Cable assembly 160 comprises cable 161 which includes cable end assembly 200 attached at one end and cable end assembly 199 attached at the other end. Generally, the middle section of cable 161 is routed around pulley 165 in double pulley free floater 155. Respective sides of cable 161 are then routed downward and around fixed pulleys 166 and 167. After passing fixed pulley 166, this side of cable 161 is then routed upward and around fixed pulley 168, then outward and around fixed pulley 169. Cable 161 is then routed downward and around linearly adjustable pulley 170. This is where one end of cable assembly 160 exits carriage assembly 85. Cable end assembly 200 bumpers against swivel pulley assembly 105 and provides this end of cable 161 a rest position when not in use as well as an attachment point for handle assembly 190. After passing fixed pulley 167, the other side of cable 161 is then routed outward and around fixed pulley 172. Cable 161 is then routed upward and then tied into carriage assembly 85. Cable end assembly 199 secures this end of cable 161 into cable tie in plates 94. Both ends of cable 161 are routed towards carriage assembly 85 from opposite directions therefore closing cable 161 into a loop wherein cable assembly 160 will maintain a substantially constant tension when carriage assembly 85 is linearly adjusted into the desired position. Linearly adjustable pulley 171 serves as a guide pulley when one end of cable assembly 161 is pressed or pulled. When one end of cable assembly 161 is pressed or pulled, double pulley free floater 155 is pulled downward which causes cable assembly 150 to pull single pulley free floater 127 downward which causes cable assembly 121 to lift weight stack 15 therefore providing a 1 to 1 mechanical advantage to the user. Those skilled in the art will appreciate that the other end of cable 161 could also be made to exit a swivel pulley assembly for pressing or pulling by a user rather than being tied into carriage 85.

Cable assembly 175 comprises cable 176 which includes cable end assembly 200 attached at one end and cable end assembly 199 attached at the other end. Generally, the middle section of cable 176 is routed around pulley 178 in single pulley free floater 177. Respective sides of cable 176 are then routed downward and around fixed pulleys 179 and 180. After passing fixed pulley 179, this side of cable 176 is then routed upward and around fixed pulley 181, then outward and around fixed pulley 182. Cable 176 is then routed downward and around linearly adjustable pulley 183. This is where one end of cable assembly 175 exits carriage assembly 85. Cable end assembly 200 bumpers against swivel pulley assembly 105 and provides this end of cable 176 a rest position when not in use as well as an attachment point for handle assembly 190. After passing fixed pulley 180, the other side of cable 176 is then routed outward and around fixed pulley 185. Cable 176 is then routed upward and then tied into carriage assembly 85. Cable end assembly 199 secures this end of cable 176 into cable tie in plates 94. Both ends of cable 176 are routed towards carriage assembly 85 from opposite directions therefore closing cable 176 into a loop wherein cable assembly 175 will maintain a substantially constant tension when carriage assembly 85 is linearly adjusted into the desired position. Linearly adjustable pulley 184 serves as a guide pulley when one end of cable assembly 175 is pressed or pulled. When one end of cable assembly 175 is pressed or pulled, single pulley free floater 177 is pulled downward which causes cable assembly 121 to lift weight stack 15 therefore providing a 4 to 1 mechanical advantage to the user. Those skilled in the art will appreciate that the other end of cable 176 could also be made to exit a swivel pulley assembly for pressing or pulling by a user rather than being tied into carriage 85.

To exercise with the linearly adjustable multi resistance ratio exercise apparatus 10, the user will select which handle assembly 190 will best suit their exercising objectives based on the amount of cable travel and the amount of resistance needed. The user will then adjust the selected carriage assembly 85 by unlocking locking pin 95 and by relocking locking pin 95 into the desired aperture in column 56, 57, or 58. Based on which handle assembly 190 and mechanical advantage was selected, the user will then select the appropriate amount of resistance from weight stack 15. The user will then press or pull handle assembly 190 to perform one of many known exercises in the art. As the user exercises, the swivel pulley assembly 105 will pivot into the direction the user is pressing or pulling thus allowing smooth user defined movements. In this embodiment, if one end of cable assembly 135 is pressed or pulled, the user will receive a 2 to 1 mechanical advantage. If one end of cable assembly 160 is pressed or pulled, the user will receive a 1 to 1 ratio of resistance. If one end of cable assembly 175 is pressed or pulled, the user will receive a 4 to 1 mechanical advantage. A lower ratio of resistance will provide less resistance and also allow more cable travel which is typically needed for functional training exercises. A higher ratio of resistance will provide more resistance for strength training movements wherein long cable travel is not required.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Also, alternate carriage assemblies and tracks could be used such as carriages that track on roller wheels or roller bearings.

Figure 5:
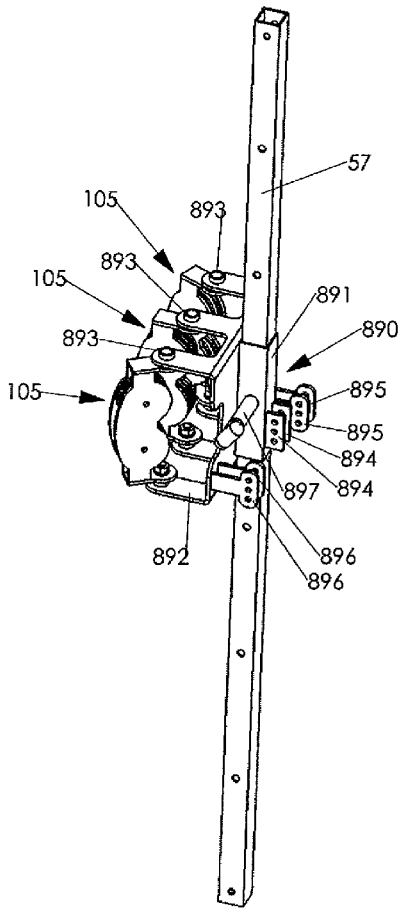
FIG. 5 is a perspective view illustrating an exemplary track for an alternate embodiment linearly adjustable carriage assembly.
Figure 5:
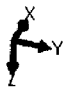

FIG. 5 illustrates an exemplary column 57 along with an alternate embodiment sleeve assembly 890 which has three pivotally attached swivel pulley assemblies 105. The alternate embodiment sleeve assembly 890 comprises sleeve 891 which slides up and down on column 57. Bracket 892 is attached to sleeve 891 on one side and provides pivoting attachment points for swivel pulley assemblies 105 on pivot sleeves 893. Locking pin 897 secures sleeve assembly 890 into the desired location along column 57. If this alternate embodiment sleeve assembly 890 was used in linearly adjustable multi resistance ratio exercise apparatus 10, cable tie in plates 896, 894, and 895 would secure one end of cables 136, 161, and 176 of cable system 120. Also, all three swivel pulley assemblies 105 would be adjusted simultaneously on one track.

Figure 6:
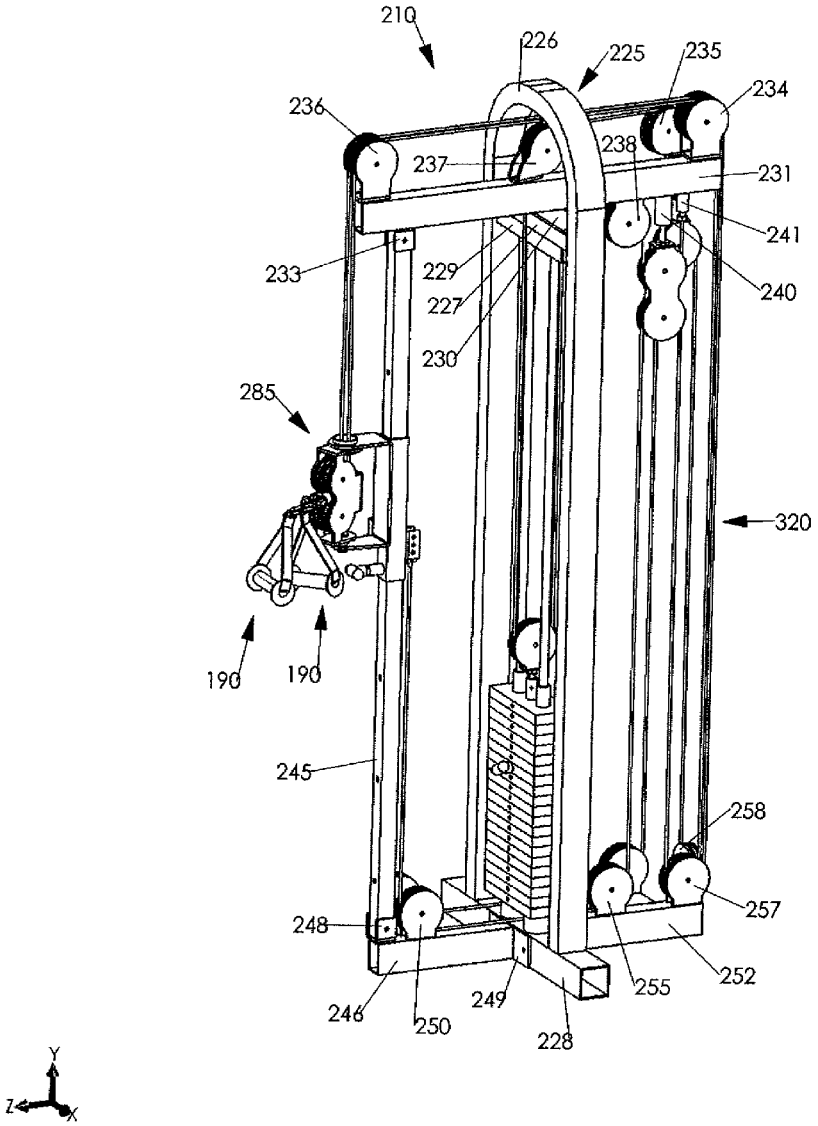
FIG. 6 is a perspective view illustrating an alternate embodiment of a linearly adjustable multi resistance ratio exercise apparatus from the front left side.
Figure 7:
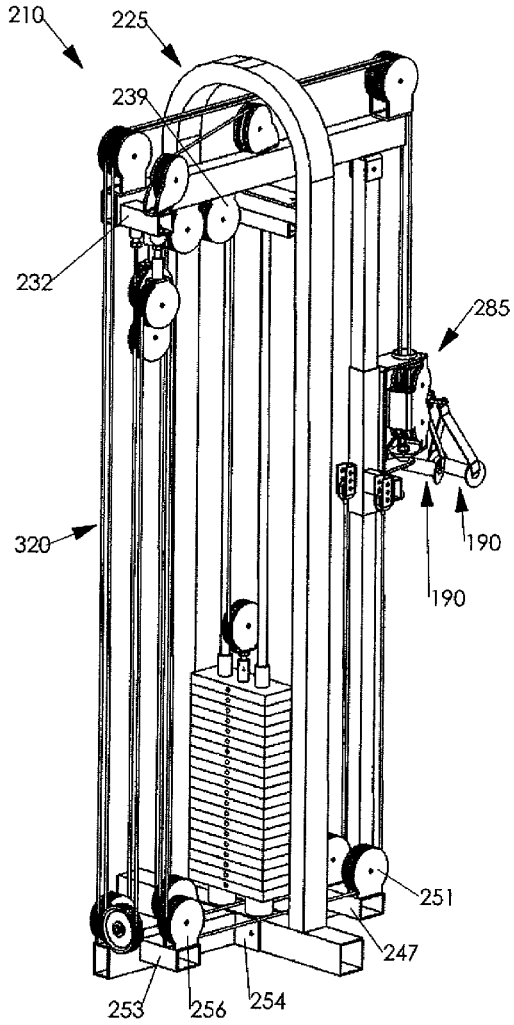
FIG. 7 is a perspective view illustrating an alternate embodiment of a linearly adjustable multi resistance ratio exercise apparatus from the back right side.
Figure 7:
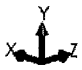

FIGS. 6 and 7 illustrate an alternate embodiment of a linearly adjustable multi resistance ratio exercise apparatus which is generally indicated by the numeral 210 and which comprises a weight stack 15 to provide resistance, a frame 225 to provide structural support and stability, one linearly adjustable carriage assembly 285, cable system 320, and two handle assemblies 190. FIG. 6 illustrates linearly adjustable multi resistance ratio exercise apparatus 210 from the front wherein one linearly adjustable carriage assembly 285 is adjusted to a middle position along column 245. FIG. 7 illustrates linearly adjustable multi resistance ratio exercise apparatus 210 from the back.

Figure 8:
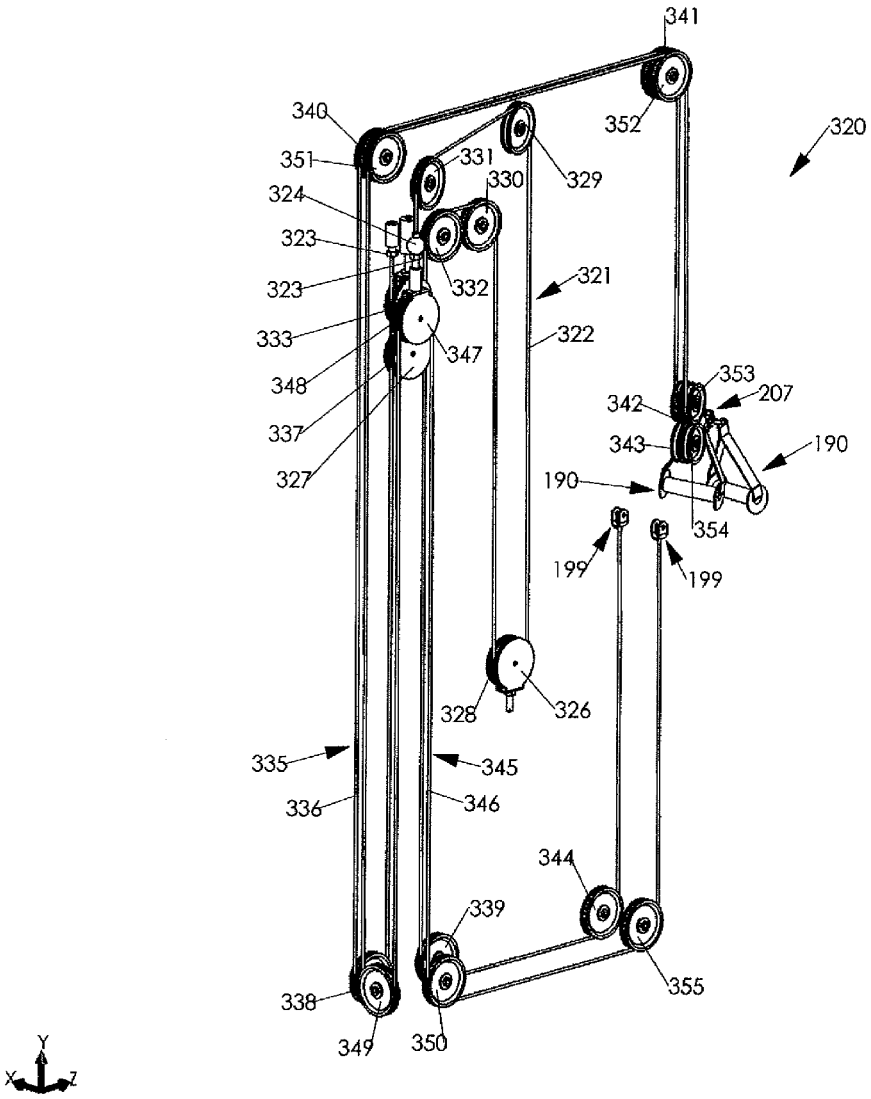
FIG. 8 is a perspective view illustrating the cable and pulley system of an alternate embodiment linearly adjustable multi resistance ratio exercise apparatus from the back right side.

The frame may have a variety of configurations depending on the specific application. In one embodiment, as shown in FIGS. 6 and 7, the frame 225 includes a weight stack cage 226, which houses the weight stack 15, and sits on cage bottom 228, which secures the bottom of guide rods 20. Cross member 227 is attached to near the top of weight stack cage 226 and secures guide rod tube 229 which secures the tops of guide rods 20. A front bottom portion of the frame 225 includes front plate 249 which is attached to the front of cage bottom 228. Front bottom tube 246 is attached to front plate 249 and provides an attachment point for front bottom outside tube 247. Column bracket 248 is attached on top of front bottom tube 246 and secures the bottom of column 245. As also illustrated in FIG. 8, pulley plates 251 are attached on top of front bottom outside tube 247 and secure pulley 355. Pulley plates 250 are attached on top of front bottom tube 246 and secure pulley 344.

The frame 225 further includes a back bottom portion which includes back plate 254 which is attached to the back of cage bottom 228. Back bottom tube 252 is attached to back plate 254 and provides an attachment point for back bottom outside tube 253. Pulley plates 256 are attached on top of back bottom outside tube 253 and secure pulley 350. Pulley plates 255, 257, and 258 are attached on top of back bottom tube 252 and secure pulleys 339, 338, and 349.

The frame 225 further includes a top portion which includes top tube 231 which is attached to top plate 230 which is secured on top of cross member 227. Top tube 231 provides an attachment point for top outside tube 232. Pulley bracket 235 is attached on top of top outside tube 232 and secures pulley 331. Pulley bracket 236, pulley bracket 237, and pulley bracket 234 are attached on top of top tube 231 and secure pulleys 341, 352, 329, 340, and 351. Pulley plates 239 and 238 are attached underneath of top tube 231 and secure pulleys 330 and 332. Leveler lockout 240 is attached underneath top tube 231 and prevents double free floater 327 from upwards travel. Cable retainer 241 is attached underneath top tube 231 and secures one end of cable assembly 321. Top outside tube 232 prevents stop member 324 from upwards travel. Column bracket 233 is attached underneath top tube 231 and secures the top of column 245.

Figure 9:
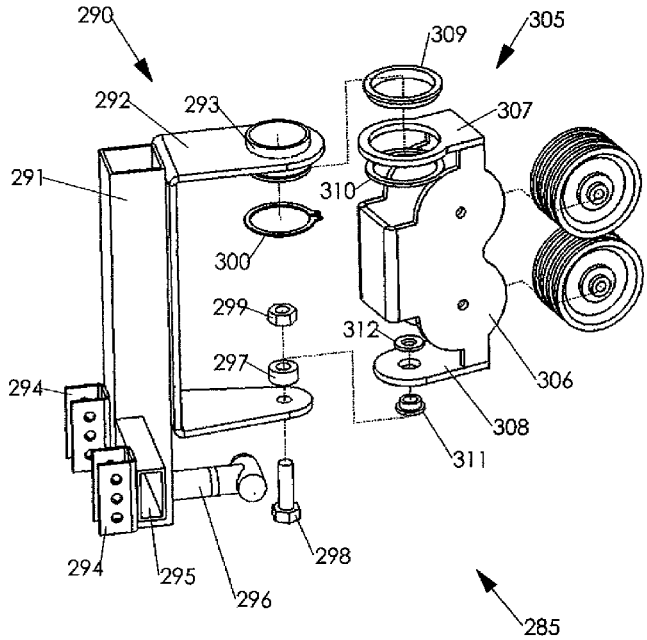
FIG. 9 is a perspective view illustrating an alternate embodiment linearly adjustable carriage assembly.
Figure 9:
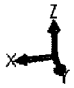

In this embodiment, the linearly adjustable multi ratio resistance exercise apparatus 210 comprises one linearly adjustable carriage assembly 285. As illustrated in FIG. 9, a linearly adjustable carriage assembly 285 comprises a sleeve assembly 290 and a swivel pulley assembly 305.

A sleeve assembly 290 comprises sleeve 291 which forms a perimeter around column 245 and slidingly retains the carriage assembly 285 onto the linearly adjustable multi resistance ratio exercise apparatus 210. A bracket 292 is attached to one side of sleeve 291. Pivot sleeve 293 is attached at the top of bracket 292 and provides a pivot point for swivel pulley assembly 305. Bolt 298, spacer 297, nut 299, and retaining ring 300 secure swivel pulley assembly 305 to the sleeve assembly 290. Locking pin 296 is attached to one side of sleeve 291 and secures the carriage assembly 285 into the desired location along column 245. Support tube 295 is attached to the side of sleeve 291 and provides an attachment point for one cable tie in bracket 294. Both cable tie in brackets 294 secure two respective ends of two closed cable loops within cable system 320.

A swivel pulley assembly 305 comprises pulley bracket 306 which secures four pulleys. Top pivot plate 307 is attached to the top of pulley bracket 306 and includes bushings 309 and 310 and pivotally attaches swivel pulley assembly 305 to sleeve assembly 290. Bottom pulley plate 308 is attached to the bottom of pulley bracket 306 and includes bushings 311 and 312 and pivotally attaches swivel pulley assembly 305 to sleeve assembly 290.

In this embodiment, as illustrated in FIG. 8, cable system 320 includes cable assembly 321, cable assembly 335, cable assembly 345, weight stack pulley bracket 326, double pulley free floater 327, and single pulley free floater 347. Cable assembly 321 is directly connected with the weight stack 15 and serves as a main cable sector wherein cable assemblies 335 and 345 can tap into and interconnect with resistance.

Cable assembly 321 comprises cable 322 which includes stop member 324 and cable bolt 323 attached at one end and cable bolt 323 attached at the other end. Cable 322 is routed through top outside tube 232 then over fixed pulleys 331 and 329, then downward and around pulley 328 in weight stack pulley bracket 326. Cable 322 is then routed upwards and over fixed pulleys 330 and 332, then downwards and around pulley 333 in double pulley free floater 327. This end of cable 322 is then retained by cable retainer 241. Top outside tube 232 prohibits upward travel of the other end of cable 322 by bracing against stop member 324.

Cable assembly 335 comprises cable 336 which includes cable end assembly 207 attached at one end and cable end assembly 199 attached at the other end. Generally, the middle section of cable 336 is routed around pulley 337 in double pulley free floater 327. Respective sides of cable 336 are then routed downward and around fixed pulleys 338 and 339. After passing fixed pulley 338, this side of cable 336 is then routed upward and around fixed pulley 340, then outward and around fixed pulley 341. Cable 336 is then routed downward and around linearly adjustable pulley 342. This is where one end of cable assembly 335 exits carriage assembly 85. Cable end assembly 207 bumpers against swivel pulley assembly 305 and provides this end of cable 336 a rest position when not in use as well as an attachment point for handle assembly 190. After passing fixed pulley 339, the other side of cable 336 is then routed outward and around fixed pulley 344. Cable 336 is then routed upward and then tied into carriage assembly 285. Cable end assembly 199 secures this end of cable 336 into cable tie in bracket 294. Both ends of cable 336 are routed towards carriage assembly 285 from opposite directions therefore closing cable 336 into a loop wherein cable assembly 335 will maintain a substantially constant tension when carriage assembly 285 is linearly adjusted into the desired position. Linearly adjustable pulley 343 serves as a guide pulley when one end of cable assembly 335 is pressed or pulled. When one end of cable assembly 335 is pressed or pulled, double pulley free floater 327 is pulled downward which causes cable assembly 321 to lift weight stack 15 therefore providing a 2 to 1 mechanical advantage to the user. Those skilled in the art will appreciate that the other end of cable 336 could also be made to exit a swivel pulley assembly for pressing or pulling by a user rather than being tied into carriage 285.

Cable assembly 345 comprises cable 346 which includes cable end assembly 207 attached at one end and cable end assembly 199 attached at the other end. Generally, the middle section of cable 345 is routed around pulley 348 in single pulley free floater 347. Respective sides of cable 346 are then routed downward and around fixed pulleys 349 and 350. After passing fixed pulley 349, this side of cable 346 is then routed upward and around fixed pulley 351, then outward and around fixed pulley 352. Cable 346 is then routed downward and around linearly adjustable pulley 353. This is where one end of cable assembly 345 exits carriage assembly 285. Cable end assembly 207 bumpers against swivel pulley assembly 305 and provides this end of cable 346 a rest position when not in use as well as an attachment point for handle assembly 190. After passing fixed pulley 350, the other side of cable 346 is then routed outward and around fixed pulley 355. Cable 346 is then routed upward and then tied into carriage assembly 285. Cable end assembly 199 secures this end of cable 346 into cable tie in bracket 294. Both ends of cable 346 are routed towards carriage assembly 285 from opposite directions therefore closing cable 346 into a loop wherein cable assembly 345 will maintain a substantially constant tension when carriage assembly 285 is linearly adjusted into the desired position. Linearly adjustable pulley 354 serves as a guide pulley when one end of cable assembly 345 is pressed or pulled. When one end of cable assembly 345 is pressed or pulled, single pulley free floater 347 is pulled downward which causes cable assembly 321 to lift weight stack 15 therefore providing a 4 to 1 mechanical advantage to the user. Those skilled in the art will appreciate that the other end of cable 346 could also be made to exit a swivel pulley assembly for pressing or pulling by a user rather than being tied into carriage 285.

To exercise with the linearly adjustable multi resistance ratio exercise apparatus 210, the user will select which handle assembly 190 will best suit their exercising objectives based on the amount of cable travel and the amount of resistance needed. The user will then adjust carriage assembly 285 by unlocking locking pin 296 and by relocking locking pin 296 into the desired aperture in column 245. Based on which handle assembly 190 and mechanical advantage was selected, the user will then select the appropriate amount of resistance from weight stack 15. The user will then press or pull handle assembly 190 to perform one of many known exercises in the art. As the user exercises, the swivel pulley assembly 305 will pivot into the direction the user is pressing or pulling thus allowing smooth user defined movements. In this embodiment, if one end of cable assembly 335 is pressed or pulled, the user will receive a 2 to 1 mechanical advantage. If one end of cable assembly 345 is pressed or pulled, the user will receive a 4 to 1 mechanical advantage. Also, because both cable assemblies share one swivel pulley assembly 305, one end of cable assembly 335 and one end of cable assembly 345 could be attached to one handle assembly 190 and yet provide another ratio of resistance. A lower ratio of resistance will provide less resistance and also allow more cable travel which is typically needed for functional training exercises. A higher ratio of resistance will provide more resistance for strength training movements wherein long cable travel is not required.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Also, alternate carriage assemblies and tracks could be used such as carriages that track on roller wheels or roller bearings.

Figure 10:
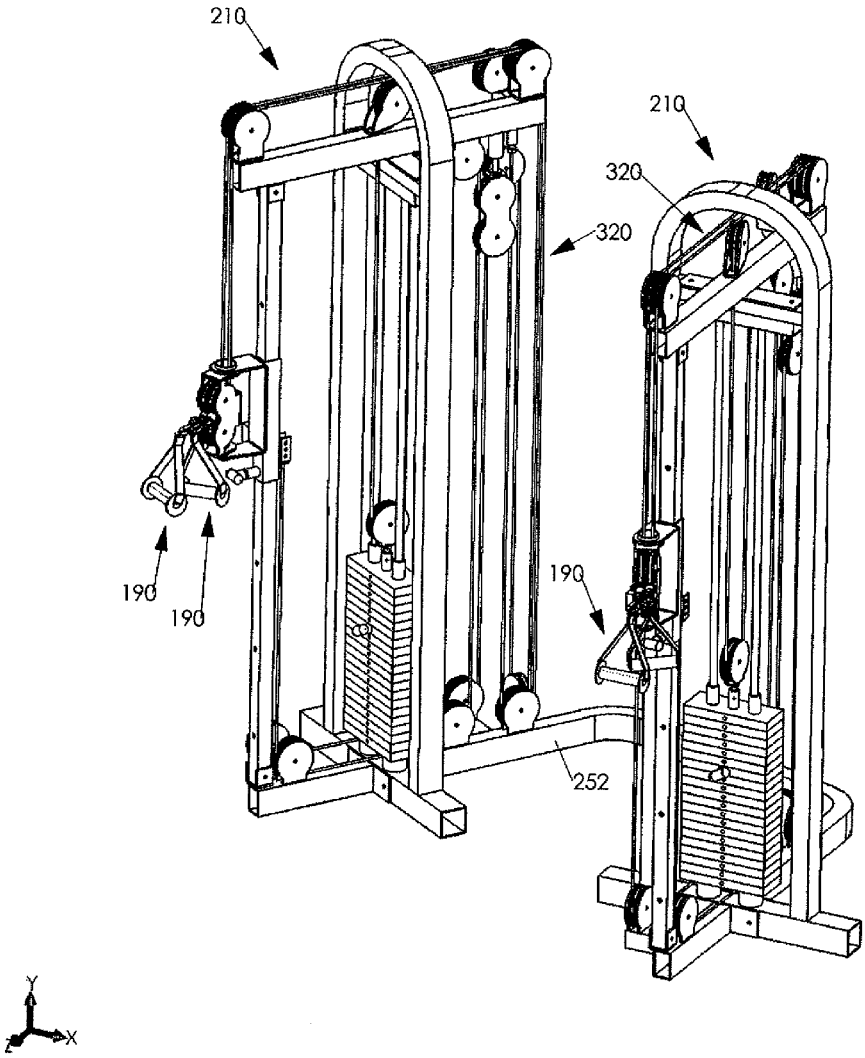
FIG. 10 is a perspective view illustrating an embodiment of two linearly adjustable multi resistance ratio exercise apparatus's combined into one exercise apparatus.

FIG. 10 illustrates an embodiment of two linearly adjustable multi resistance ratio exercise apparatus's 210 connected at the bottom with frame bottom 252 therefore being combined into one exercise apparatus. This would increase the number of functional and strength training exercises known in the art that a user could perform. The appropriate handle assemblies 190 can be pressed or pulled based on length of cable travel needed as well as the amount of resistance needed.

Figure 11:
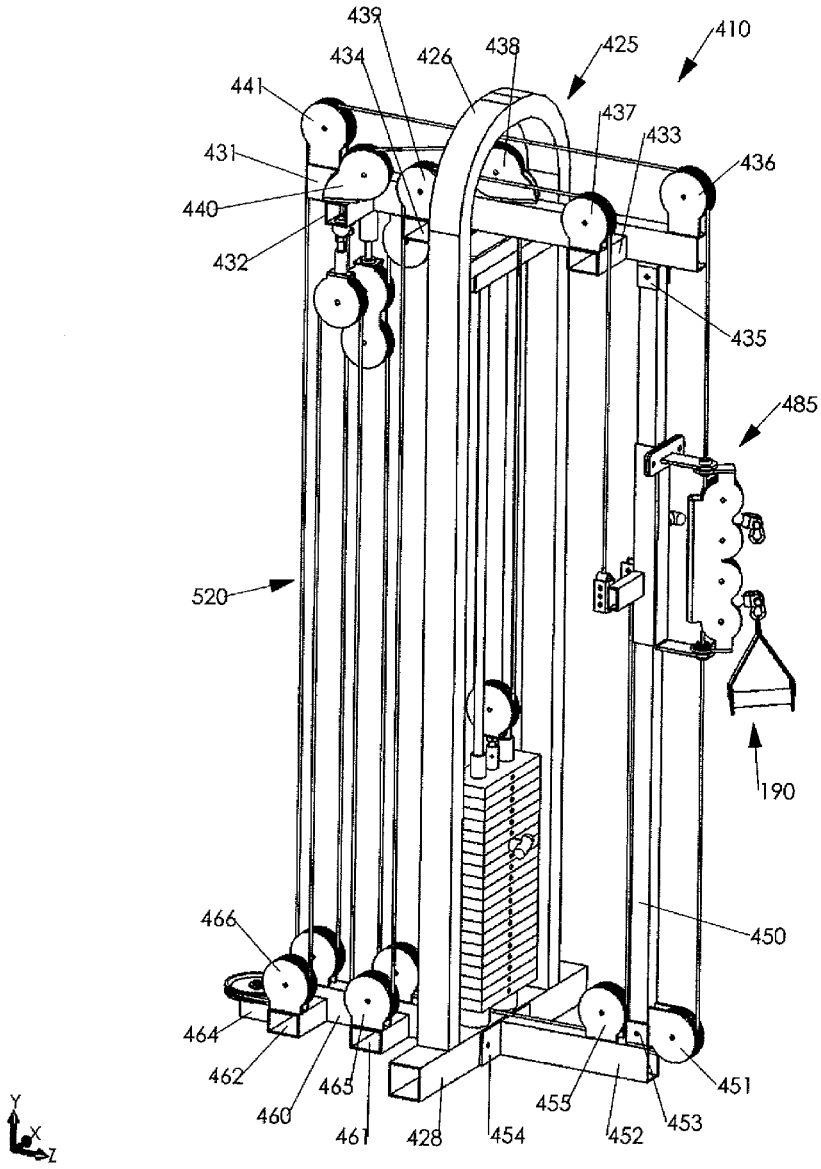
FIG. 11 is a perspective view illustrating an alternate embodiment of a linearly adjustable multi resistance ratio exercise apparatus from the front right side.
Figure 13:
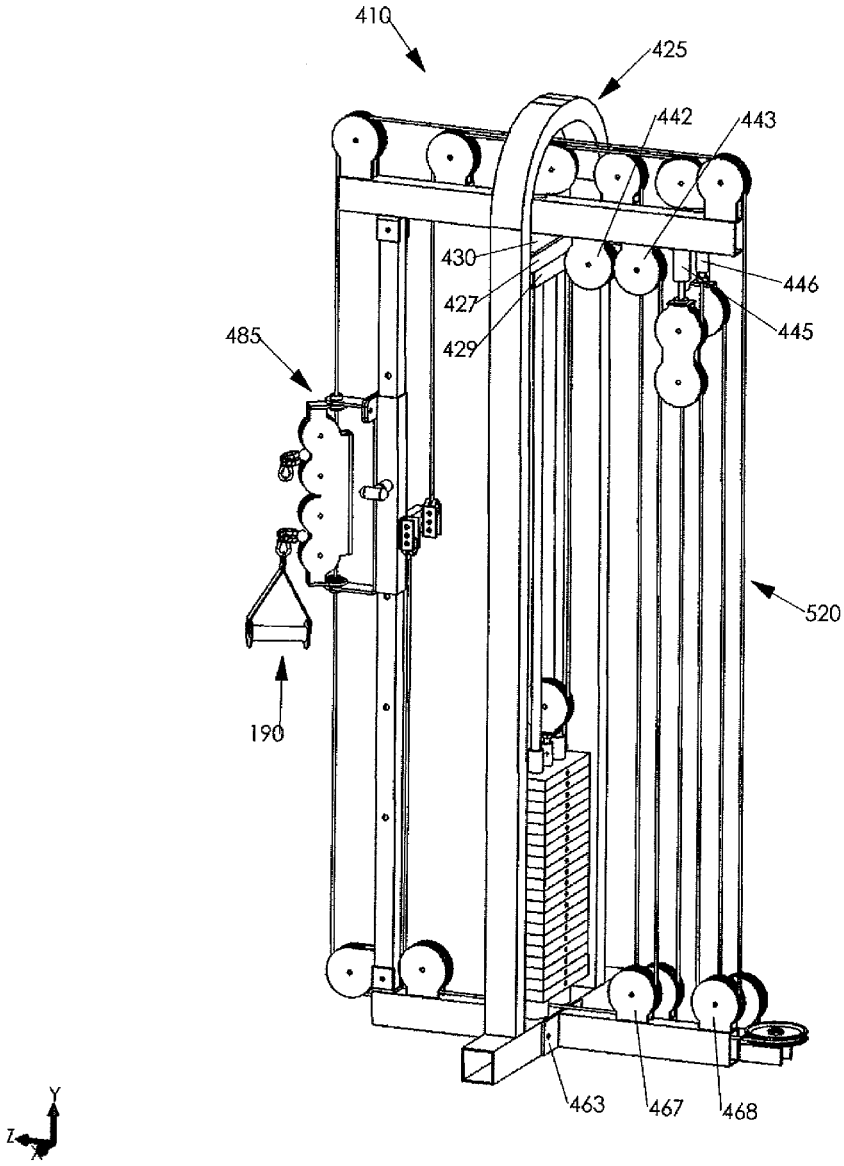
FIG. 13 is a perspective view illustrating an alternate embodiment of a linearly adjustable multi resistance ratio exercise apparatus from the back left side.

FIGS. 11 and 13 illustrate an alternate embodiment of a linearly adjustable multi resistance ratio exercise apparatus which is generally indicated by the numeral 410 and which comprises a weight stack 15 to provide resistance, a frame 425 to provide structural support and stability, one linearly adjustable carriage assembly 485, cable system 520, and one handle assembly 190. FIG. 11 illustrates linearly adjustable multi resistance ratio exercise apparatus 410 from the front wherein one linearly adjustable carriage assembly 485 is adjusted to a generally middle position along column 450. FIG. 13 illustrates linearly adjustable multi resistance ratio exercise apparatus 410 from the back.

Figure 12:
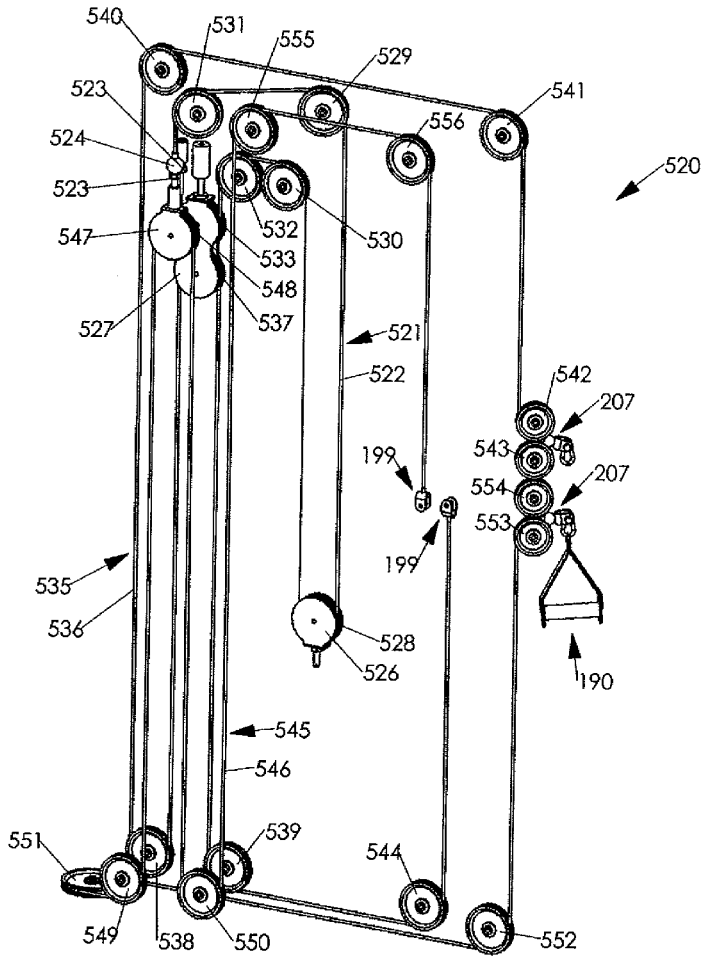
FIG. 12 is a perspective view illustrating the cable and pulley system of an alternate embodiment linearly adjustable multi resistance ratio exercise apparatus from the front right side.
Figure 12:
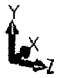

The frame may have a variety of configurations depending on the specific application. In one embodiment, as shown in FIGS. 11 and 13, the frame 425 includes a weight stack cage 426, which houses the weight stack 15, and sits on cage bottom 428, which secures the bottom of guide rods 20. Cross member 427 is attached to near the top of weight stack cage 426 and secures guide rod tube 429 which secures the tops of guide rods 20. A front bottom portion of the frame 425 includes front plate 454 which is attached to the front of cage bottom 428. Front bottom tube 452 is attached to front plate 454. Column bracket 453 is attached on top of front bottom tube 452 and secures the bottom of column 450. As also illustrated in FIG. 12, pulley plates 455 are attached on top of front bottom tube 452 and secure pulley 544. Pulley plates 451 are attached at the bottom end of column 450 and secure pulley 552.

The frame 425 further includes a back bottom portion which includes back plate 463 which is attached to the back of cage bottom 428. Back bottom tube 460 is attached to back plate 463 and provides an attachment point for back bottom outside tubes 461 and 462. Pulley plates 465 and 466 are attached on top of back bottom outside tubes 461 and 462 and secure pulleys 550 and 549. Pulley plates 467 and 468 are attached on top of back bottom tube 460 and secure pulleys 539 and 538. Pulley bracket 464 is attached to back bottom outside tube 462 and secures pulley 551.

The frame 425 further includes a top portion which includes top tube 431 which is attached to top plate 430 which is secured on top of cross member 427. Top tube 431 provides an attachment point for top outside tubes 433, 434, and 432. Pulley bracket 440 is attached on top of top outside tube 432 and secures pulley 531. Pulley plates 437 and 439 are attached on top of top outside tubes 433 and 434 and secure pulleys 556 and 555. Pulley bracket 438 is attached on top of top tube 431 and secures pulley 529. Pulley plates 436 and 441 are attached on top of top tube 431 and secure pulleys 541 and 540. Pulley plates 442 and 443 are attached underneath of top tube 431 and secure pulleys 530 and 532. Leveler lockout 445 is attached underneath top tube 431 and prevents double free floater 527 from upwards travel. Cable retainer 446 is attached underneath top tube 431 and secures one end of cable assembly 521. Top outside tube 432 prevents stop member 524 from upwards travel. Column bracket 435 is attached underneath top tube 431 and secures the top of column 450.

Figure 14:
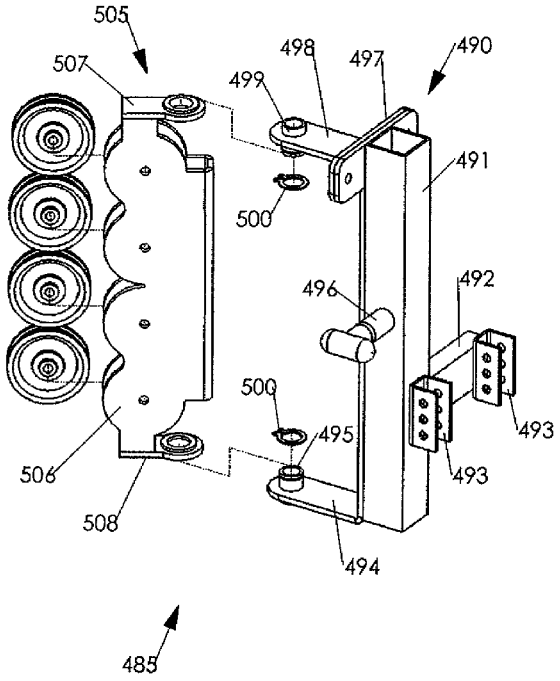
FIG. 14 is a perspective view illustrating an alternate embodiment linearly adjustable carriage assembly.
Figure 14:
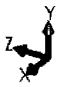

In this embodiment, the linearly adjustable multi ratio resistance exercise apparatus 410 comprises one linearly adjustable carriage assembly 485. As illustrated in FIG. 14, a linearly adjustable carriage assembly 485 comprises a sleeve assembly 490 and a swivel pulley assembly 505.

A sleeve assembly 490 comprises sleeve 491 which forms a perimeter around column 450 and slidingly retains the carriage assembly 485 onto the linearly adjustable multi resistance ratio exercise apparatus 410. A bracket 494 is attached to one side of sleeve 491. Pivot sleeve 495 is attached at the bottom of bracket 494 and provides a pivot point for swivel pulley assembly 505. A top bracket portion includes plate 497 which is secured to bracket 494. Pivot sleeve 499 is attached to plate 498 which is attached to plate 497. Pivot sleeve 499 provides a pivot point for swivel pulley assembly 505. Retaining rings 500 secure swivel pulley assembly 505 to the sleeve assembly 490. Locking pin 496 is attached to one side of sleeve 491 and secures the carriage assembly 485 into the desired location along column 450. Support tube 492 is attached to the side of sleeve 491 and provides an attachment point for one cable tie in bracket 493. Both cable tie in brackets 493 secure two respective ends of two closed cable loops within cable system 520.

A swivel pulley assembly 505 comprises pulley bracket 506 which secures four pulleys. Top pivot plate 507 is attached to the top of pulley bracket 506 and pivotally attaches swivel pulley assembly 505 to sleeve assembly 490. Bottom pulley plate 508 is attached to the bottom of pulley bracket 506 and pivotally attaches swivel pulley assembly 505 to sleeve assembly 490.

Figure 15:
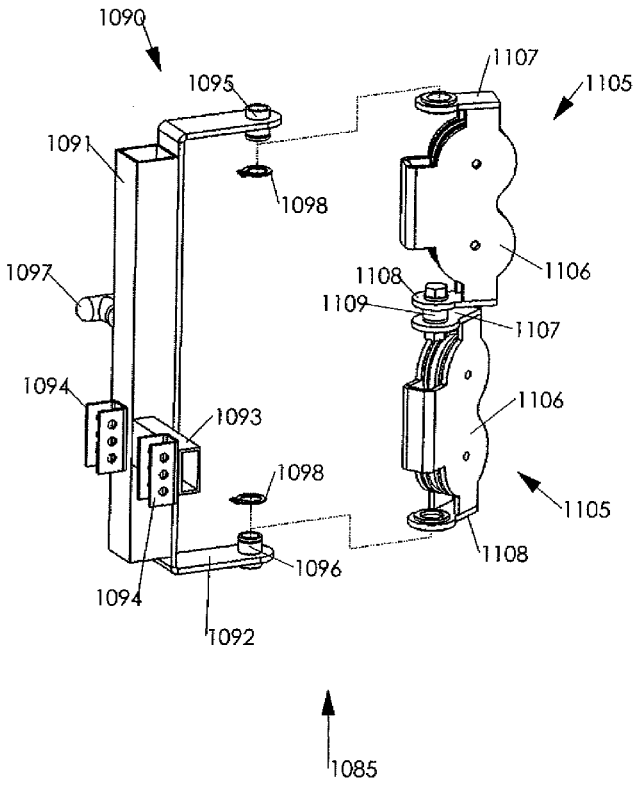
FIG. 15 is a perspective view illustrating an alternate embodiment linearly adjustable carriage assembly.
Figure 15:
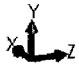

FIG. 15 illustrates an alternate embodiment of a carriage assembly and is generally indicated by the number 1085. It is similar to the above mentioned carriage assembly 485 and can be used on the above mentioned embodiment of linearly adjustable multi resistance ratio exercise apparatus 410. Carriage assembly 1085 comprises a sleeve assembly 1090 and two independently pivoting swivel pulley assemblies 1105.

Sleeve assembly 1090 comprises sleeve 1091 which forms a perimeter around column 450 and slidingly retains the carriage assembly 1085 onto the linearly adjustable multi resistance ratio exercise apparatus 410. A bracket 1092 is attached to one side of sleeve 1091. Pivot sleeve 1096 is attached at the bottom of bracket 1092 and provides a pivot point for bottom swivel pulley assembly 1105. Pivot sleeve 1095 is attached at the top of bracket 1092 and provides a pivot point for top swivel pulley assembly 1105. Retaining rings 1098 secure swivel pulley assemblies 1105 to the sleeve assembly 1090. Locking pin 1097 is attached to one side of sleeve 1091 and secures the carriage assembly 1085 into the desired location along column 450. Support tube 1093 is attached to the side of sleeve 1091 and provides an attachment point for one cable tie in bracket 1094. Both cable tie in brackets 1094 secure two respective ends of two closed cable loops within cable system 520.

Top swivel pulley assembly 1105 comprises pulley bracket 1106 which secures two pulleys. Top pivot plate 1107 is attached to the top of pulley bracket 1106 and pivotally attaches swivel pulley assembly 1105 to sleeve assembly 1090. Bottom pulley plate 1108 is attached to the bottom of pulley bracket 1106. Bottom swivel pulley assembly 1105 comprises pulley bracket 1106 which secures two pulleys. Top pivot plate 1107 is attached to the top of pulley bracket 1106. Bottom pulley plate 1108 is attached to the bottom of pulley bracket 1106 and pivotally attaches swivel pulley assembly 1105 to sleeve assembly 1090. Spacer 1109 pivotally connects top swivel pulley assembly 1105 with bottom swivel pulley assembly 1105.

In this embodiment, as illustrated in FIG. 12, cable system 520 includes cable assembly 521, cable assembly 535, cable assembly 545, weight stack pulley bracket 526, double pulley free floater 527, and single pulley free floater 547. Cable assembly 521 is directly connected with the weight stack 15 and serves as a main cable sector wherein cable assemblies 535 and 545 can tap into and interconnect with resistance.

Cable assembly 521 comprises cable 522 which includes stop member 524 and cable bolt 523 attached at one end and cable bolt 523 attached at the other end. Cable 522 is routed through top outside tube 432 then over fixed pulleys 531 and 529, then downward and around pulley 528 in weight stack pulley bracket 526. Cable 522 is then routed upwards and over fixed pulleys 530 and 532, then downwards and around pulley 533 in double pulley free floater 527. This end of cable 522 is then retained by cable retainer 446. Top outside tube 432 prohibits upward travel of the other end of cable 522 by bracing against stop member 524.

Cable assembly 535 comprises cable 536 which includes cable end assembly 207 attached at one end and cable end assembly 199 attached at the other end. Generally, the middle section of cable 536 is routed around pulley 537 in double pulley free floater 527. Respective sides of cable 536 are then routed downward and around fixed pulleys 538 and 539. After passing fixed pulley 538, this side of cable 536 is then routed upward and around fixed pulley 540, then outward and around fixed pulley 541. Cable 536 is then routed downward and around linearly adjustable pulley 542. This is where one end of cable assembly 535 exits carriage assembly 485. Cable end assembly 207 bumpers against swivel pulley assembly 505 and provides this end of cable 536 a rest position when not in use as well as an attachment point for handle assembly 190. After passing fixed pulley 539, the other side of cable 536 is then routed outward and around fixed pulley 544. Cable 536 is then routed upward and then tied into carriage assembly 485. Cable end assembly 199 secures this end of cable 536 into cable tie in bracket 493. Both ends of cable 536 are routed towards carriage assembly 485 from opposite directions therefore closing cable 536 into a loop wherein cable assembly 535 will maintain a substantially constant tension when carriage assembly 485 is linearly adjusted into the desired position. Linearly adjustable pulley 543 serves as a guide pulley when one end of cable assembly 535 is pressed or pulled. When one end of cable assembly 535 is pressed or pulled, double pulley free floater 527 is pulled downward which causes cable assembly 521 to lift weight stack 15 therefore providing a 2 to 1 mechanical advantage to the user. Those skilled in the art will appreciate that the other end of cable 536 could also be made to exit a swivel pulley assembly for pressing or pulling by a user rather than being tied into carriage 485.

Cable assembly 545 comprises cable 546 which includes cable end assembly 207 attached at one end and cable end assembly 199 attached at the other end. Generally, the middle section of cable 545 is routed around pulley 548 in single pulley free floater 547. Respective sides of cable 546 are then routed downward and around fixed pulleys 549 and 550. After passing fixed pulley 549, this side of cable 546 is then routed outward and around fixed pulley 551, then outward and around fixed pulley 552. Cable 546 is then routed upward and around linearly adjustable pulley 553. This is where one end of cable assembly 545 exits carriage assembly 485. Cable end assembly 207 bumpers against swivel pulley assembly 505 and provides this end of cable 546 a rest position when not in use as well as an attachment point for handle assembly 190. After passing fixed pulley 550, the other side of cable 546 is then routed upward and around fixed pulley 555. Cable 546 is then routed outward and around fixed pulley 556. Cable 546 is then routed downward and then tied into carriage assembly 485. Cable end assembly 199 secures this end of cable 546 into cable tie in bracket 493. Both ends of cable 546 are routed towards carriage assembly 485 from opposite directions therefore closing cable 546 into a loop wherein cable assembly 545 will maintain a substantially constant tension when carriage assembly 485 is linearly adjusted into the desired position. Linearly adjustable pulley 554 serves as a guide pulley when one end of cable assembly 545 is pressed or pulled. When one end of cable assembly 545 is pressed or pulled, single pulley free floater 547 is pulled downward which causes cable assembly 521 to lift weight stack 15 therefore providing a 4 to 1 mechanical advantage to the user. Those skilled in the art will appreciate that the other end of cable 546 could also be made to exit a swivel pulley assembly for pressing or pulling by a user rather than being tied into carriage 485.

To exercise with the linearly adjustable multi resistance ratio exercise apparatus 410, the user will attach handle assembly 190 to the cable end assembly which will best suit their exercising objectives based on the amount of cable travel and the amount of resistance needed. The user will then adjust carriage assembly 485 by unlocking locking pin 496 and by relocking locking pin 496 into the desired aperture in column 450. Based on which cable end assembly 207 and mechanical advantage was selected, the user will then select the appropriate amount of resistance from weight stack 15. The user will then press or pull handle assembly 190 to perforin one of many known exercises in the art. As the user exercises, the swivel pulley assembly 505 will pivot into the direction the user is pressing or pulling thus allowing smooth user defined movements. In this embodiment, if one end of cable assembly 535 is pressed or pulled, the user will receive a 2 to 1 mechanical advantage. If one end of cable assembly 545 is pressed or pulled, the user will receive a 4 to 1 mechanical advantage. A lower ratio of resistance will provide less resistance and also allow more cable travel which is typically needed for functional training exercises. A higher ratio of resistance will provide more resistance for strength training movements wherein long cable travel is not required.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Also, alternate carriage assemblies and tracks could be used such as carriages that track on roller wheels or roller bearings.

Figure 16:
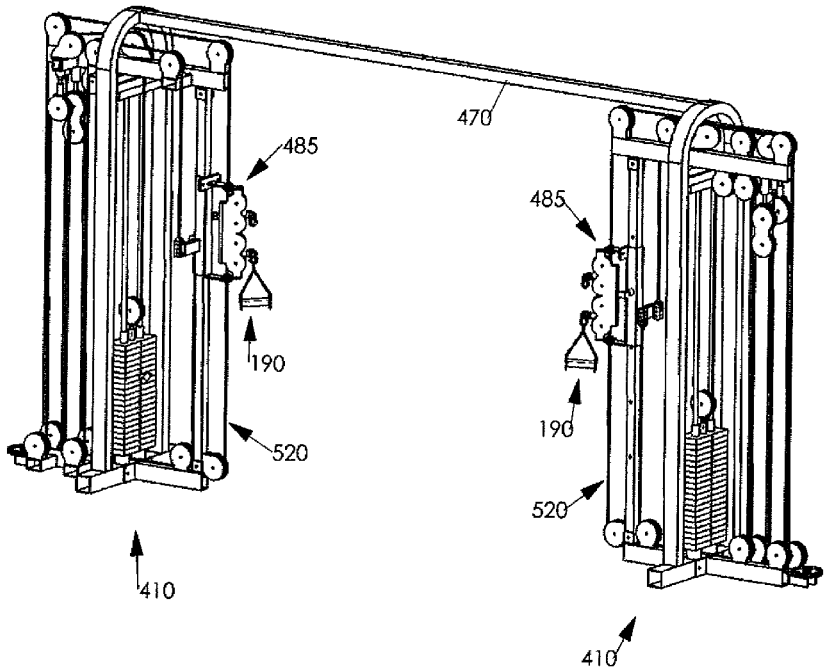
FIG. 16 is a perspective view illustrating an embodiment of two linearly adjustable multi resistance ratio exercise apparatus's combined into one exercise apparatus.
Figure 16:
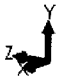

FIG. 16 illustrates an embodiment of two linearly adjustable multi resistance ratio exercise apparatus's 410 connected at the top with frame top 470 therefore being combined into one exercise apparatus. This would increase the number of functional and strength training exercises known in the art that a user could perform. The appropriate cable end assemblies 207 can be pressed or pulled based on length of cable travel needed as well as the amount of resistance needed.

Figure 17:
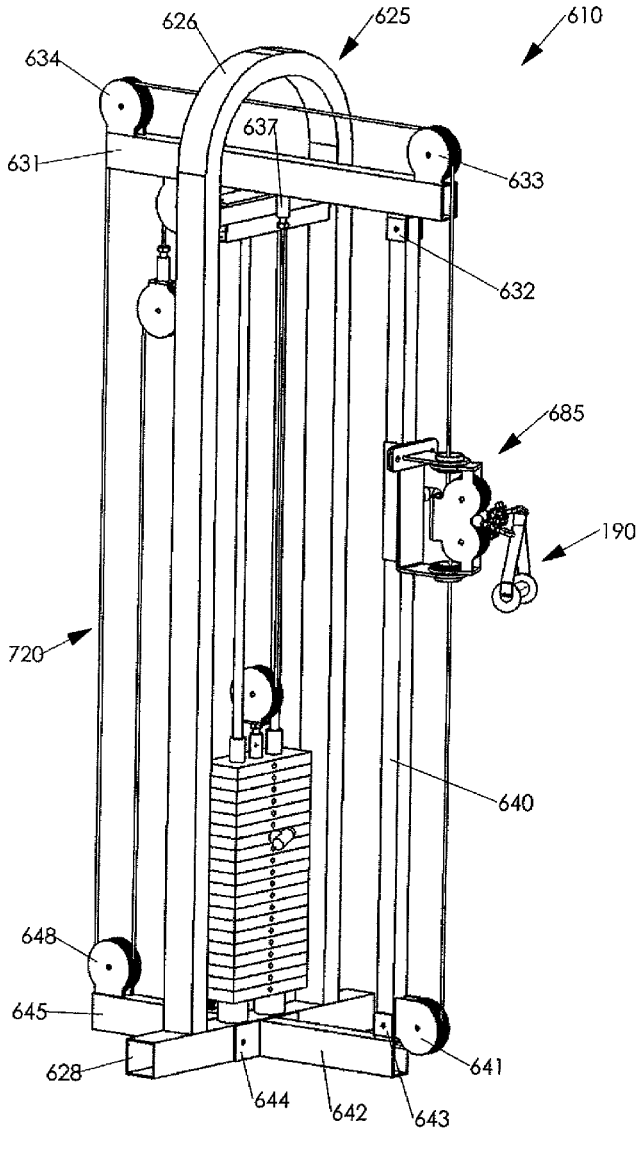
FIG. 17 is a perspective view illustrating an alternate embodiment of a linearly adjustable multi resistance ratio exercise apparatus from the front right side.
Figure 18:
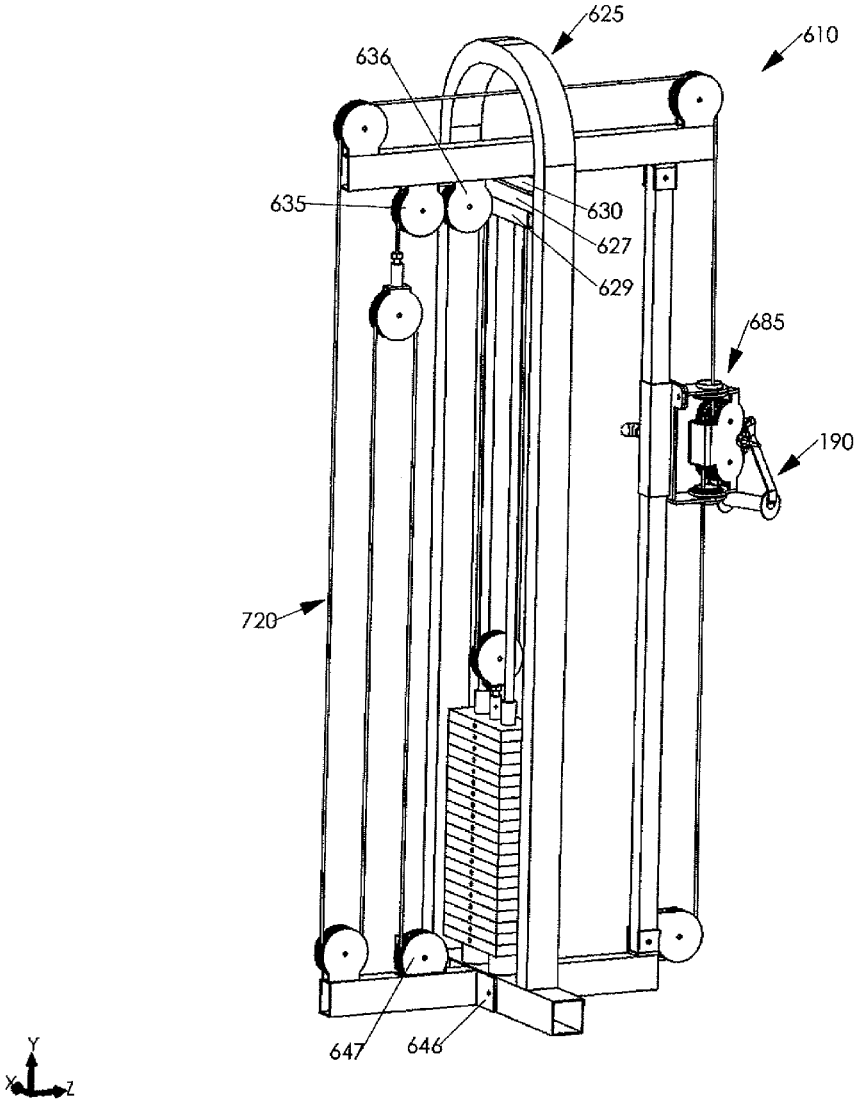
FIG. 18 is a perspective view illustrating an alternate embodiment of a linearly adjustable multi resistance ratio exercise apparatus from the back right side.

FIGS. 17 and 18 illustrate an alternate embodiment of a linearly adjustable multi resistance ratio exercise apparatus which is generally indicated by the numeral 610 and which comprises a weight stack 15 to provide resistance, a frame 625 to provide structural support and stability, one linearly adjustable carriage assembly 685, cable system 720, and one handle assembly 190. FIG. 17 illustrates linearly adjustable multi resistance ratio exercise apparatus 610 from the front wherein one linearly adjustable carriage assembly 685 is adjusted to a generally middle position along column 640. FIG. 18 illustrates linearly adjustable multi resistance ratio exercise apparatus 610 from the back.

Figure 19:
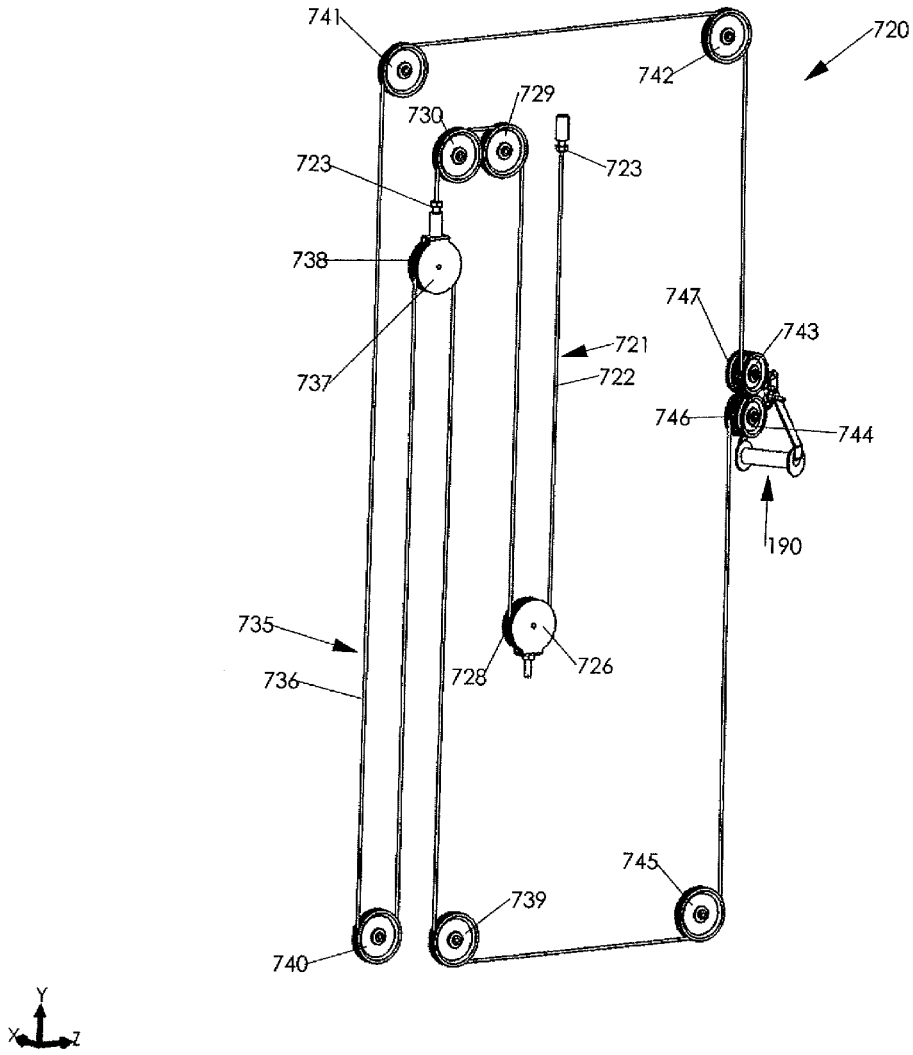
FIG. 19 is a perspective view illustrating the cable and pulley system of an alternate embodiment linearly adjustable multi resistance ratio exercise apparatus from the back right side.

The frame may have a variety of configurations depending on the specific application. In one embodiment, as shown in FIGS. 17 and 18, the frame 625 includes a weight stack cage 626, which houses the weight stack 15, and sits on cage bottom 628, which secures the bottom of guide rods 20. Cross member 627 is attached to near the top of weight stack cage 626 and secures guide rod tube 629 which secures the tops of guide rods 20. A front bottom portion of the frame 625 includes front plate 644 which is attached to the front of cage bottom 628. Front bottom tube 642 is attached to front plate 644. Column bracket 643 is attached on top of front bottom tube 642 and secures the bottom of column 640. As also illustrated in FIG. 19, pulley plates 641 are attached at the bottom end of column 640 and secure pulley 745.

The frame 625 further includes a back bottom portion which includes back plate 646 which is attached to the back of cage bottom 628. Back bottom tube 645 is attached to back plate 646. Pulley plates 647 and 648 are attached on top of back bottom tube 645 and secure pulleys 739 and 740.

The frame 625 further includes a top portion which includes top tube 631 which is attached to top plate 630 which is secured on top of cross member 627. Pulley plates 633 and 634 are attached on top of top tube 631 and secure pulleys 742 and 741. Pulley plates 636 and 635 are attached underneath of top tube 631 and secure pulleys 729 and 730. Cable retainer 637 is attached underneath top tube 631 and secures one end of cable assembly 721. Column bracket 632 is attached underneath top tube 631 and secures the top of column 640.

Figure 20:
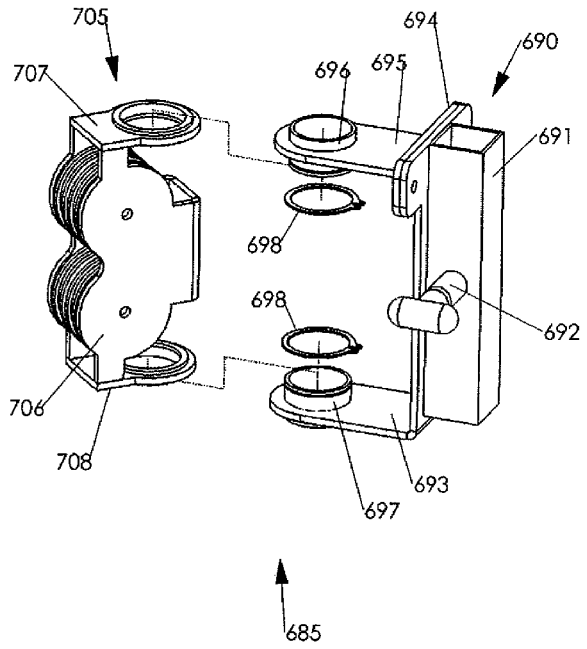
FIG. 20 is a perspective view illustrating an alternate embodiment linearly adjustable carriage assembly.
Figure 20:
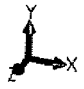

In this embodiment, the linearly adjustable multi ratio resistance exercise apparatus 610 comprises one linearly adjustable carriage assembly 685. As illustrated in FIG. 20, a linearly adjustable carriage assembly 685 comprises a sleeve assembly 690 and a swivel pulley assembly 705.

A sleeve assembly 690 comprises sleeve 691 which forms a perimeter around column 640 and slidingly retains the carriage assembly 685 onto the linearly adjustable multi resistance ratio exercise apparatus 610. A bracket 693 is attached to one side of sleeve 691. Pivot sleeve 697 is attached at the bottom of bracket 693 and provides a pivot point for swivel pulley assembly 705. A top bracket portion includes plate 694 which is secured to bracket 693. Pivot sleeve 696 is attached to plate 695 which is attached to plate 694. Pivot sleeve 696 provides a pivot point for swivel pulley assembly 705. Retaining rings 698 secure swivel pulley assembly 705 to the sleeve assembly 690. Locking pin 692 is attached to one side of sleeve 691 and secures the carriage assembly 685 into the desired location along column 640.

A swivel pulley assembly 705 comprises pulley bracket 706 which secures four pulleys. Top pivot plate 707 is attached to the top of pulley bracket 706 and pivotally attaches swivel pulley assembly 705 to sleeve assembly 690. Bottom pulley plate 708 is attached to the bottom of pulley bracket 706 and pivotally attaches swivel pulley assembly 705 to sleeve assembly 690.

In this embodiment, as illustrated in FIG. 19, cable system 720 includes cable assembly 721, cable assembly 735, weight stack pulley bracket 726, and single pulley free floater 737. Cable assembly 721 is directly connected with the weight stack 15 and serves as a main cable sector wherein cable assembly 735 can tap into and interconnect with resistance.

Cable assembly 721 comprises cable 722 which includes cable bolts 723 attached at respective ends. Generally the middle section of cable 722 is routed around pulley 728 in weight stack pulley bracket 726. One side of cable 722 is then routed upwards and is retained in cable retainer 637. The other side of cable 722 is then routed upwards and over fixed pulleys 729 and 730, then downwards and is retained in single pulley free floater 737.

Cable assembly 735 comprises cable 736 which includes a cable end assembly 207 attached at both ends. Generally, the middle section of cable 736 is routed around pulley 738 in single pulley free floater 737. Respective sides of cable 736 are then routed downward and around fixed pulleys 740 and 739. After passing fixed pulley 740, this side of cable 736 is then routed upward and around fixed pulley 741, then outward and around fixed pulley 742. Cable 736 is then routed downward and around linearly adjustable pulley 743. This is where one end of cable assembly 735 exits carriage assembly 685. Cable end assembly 207 bumpers against swivel pulley assembly 705 and provides this end of cable 736 a rest position when not in use as well as an attachment point for handle assembly 190. After passing fixed pulley 739, the other side of cable 736 is then routed outward and around fixed pulley 745. Cable 736 is then routed upward and around linearly adjustable pulley 746. This is where one end of cable assembly 735 exits carriage assembly 685. Cable end assembly 207 bumpers against swivel pulley assembly 705 and provides this end of cable 736 a rest position when not in use as well as an attachment point for handle assembly 190. Both ends of cable 736 are routed towards carriage assembly 685 from opposite directions therefore closing cable 736 into a loop wherein cable assembly 735 will maintain a substantially constant tension when carriage assembly 685 is linearly adjusted into the desired position. Linearly adjustable pulleys 744 and 747 serve as guide pulleys when a respective end of cable assembly 735 is pressed or pulled. When one end of cable assembly 735 is pressed or pulled, single pulley free floater 737 is pulled downward which causes cable assembly 721 to lift weight stack 15 therefore providing a 4 to 1 mechanical advantage to the user.

To exercise with the linearly adjustable multi resistance ratio exercise apparatus 610, the user can select between pressing or pulling one end of cable assembly 735 to obtain a 4 to 1 mechanical advantage, or by pressing or pulling both ends of cable assembly 735 by connecting both ends of cable assembly 735 to one handle assembly 190 to obtain a 2 to 1 mechanical advantage. By pressing or pulling one end of cable assembly 735 less resistance will be provided, however more cable travel will be available for functional training exercises. By pressing or pulling both ends of cable assembly 735 at the same time with one handle assembly 190, more resistance will be provided for strength training exercises that require less cable travel. Since both ends of cable assembly 735 exit the same swivel pulley assembly 705, they are close enough to one another to connect to one handle assembly 190 as illustrated in FIG. 21. Also, because the ends of cable assembly 735 exit the same swivel pulley assembly 705, swivel pulley assembly 705 will pivot in the direction the user presses or pulls both ends of cable assembly 735 along with handle assembly 190. The user will then adjust carriage assembly 685 by unlocking locking pin 692 and by relocking locking pin 692 into the desired aperture in column 640. Based on whether the user has chosen to pull one end of cable assembly 735 or both ends of cable assembly 735, the user will then select the appropriate amount of resistance from weight stack 15. The user will then press or pull handle assembly 190 to perform one of many known exercises in the art.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Also, alternate carriage assemblies and tracks could be used such as carriages that track on roller wheels or roller bearings.

Figure 23:
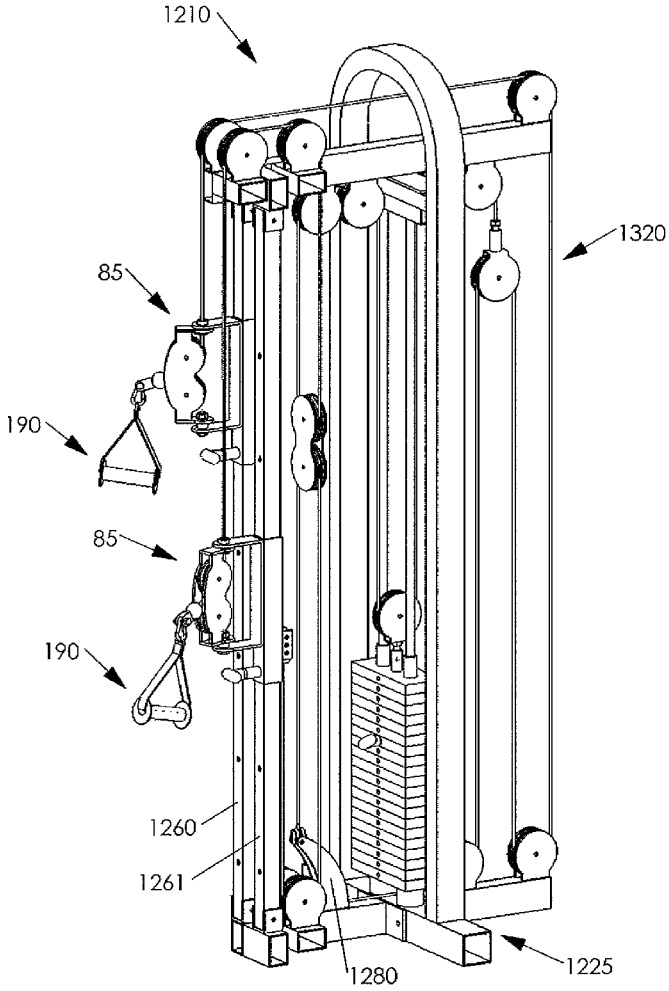
FIG. 23 is a perspective view illustrating an alternate embodiment of a linearly adjustable multi resistance ratio exercise apparatus from the front left side.
Figure 23:
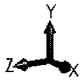
Figure 25:
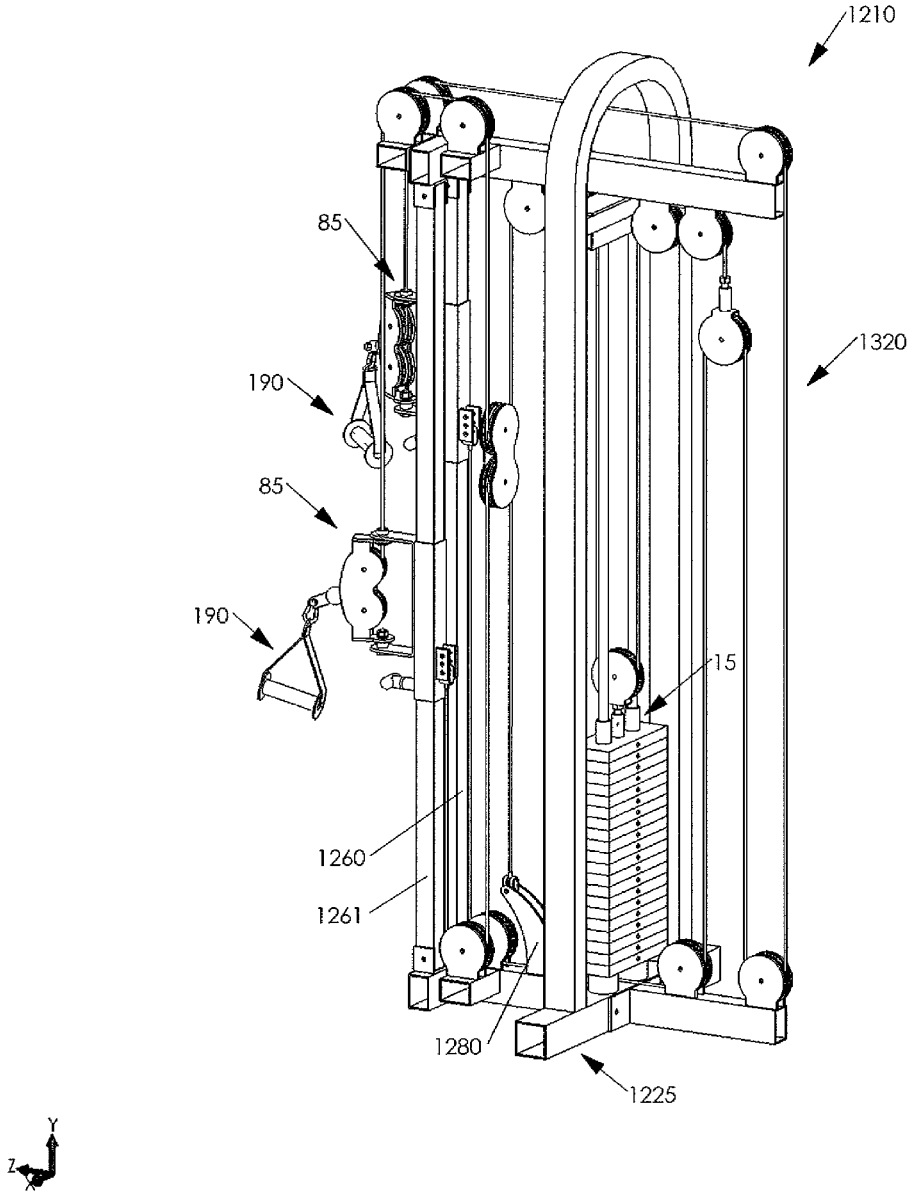
FIG. 25 is a perspective view illustrating an alternate embodiment of a linearly adjustable multi resistance ratio exercise apparatus from the back left side.

As described in paragraph 38, this invention relates to an exercise apparatus which comprises at least one flexible connecting system which includes at least two linearly adjustable flexible connector ends connected to resistance such that pulling one flexible connector end may provide an alternate resistance level than the pulling of another flexible connector end. Also, paragraphs 56, 70, 87, and 100 state that an alternate configuration of cables and pulleys could be used to carry out the present invention. FIGS. 23 and 25 illustrate an alternate embodiment linearly adjustable multi resistance ratio exercise apparatus 1210 which comprises a weight stack 15 to provide resistance, a frame 1225 to provide structural support and stability, two linearly adjustable carriage assemblies 85, cable system 1320, and two handle assemblies 190. FIG. 23 illustrates linearly adjustable multi resistance ratio exercise apparatus 1210 from the front wherein two linearly adjustable carriage assemblies 85 are adjusted to alternate positions along respective columns 1260 and 1261. FIG. 25 illustrates linearly adjustable multi resistance ratio exercise apparatus 1210 from the back wherein two linearly adjustable carriage assemblies 85 are adjusted to alternate positions along respective columns 1260 and 1261.

The frame may have a variety of configurations depending on the specific application. In one embodiment, as shown in FIGS. 23 and 25, the frame 1225 supports weight stack 15, secures numerous pulleys within cable system 1320, and includes columns 1260 and 1261.

In this alternate embodiment, the linearly adjustable multi ratio resistance exercise apparatus 1210 comprises two linearly adjustable carriage assemblies 85. Linearly adjustable carriage assembly 85 comprises a sleeve assembly 90 and a swivel pulley assembly 105 and is shown in FIG. 4 and is described in detail in paragraphs 47 and 48.

Figure 24:
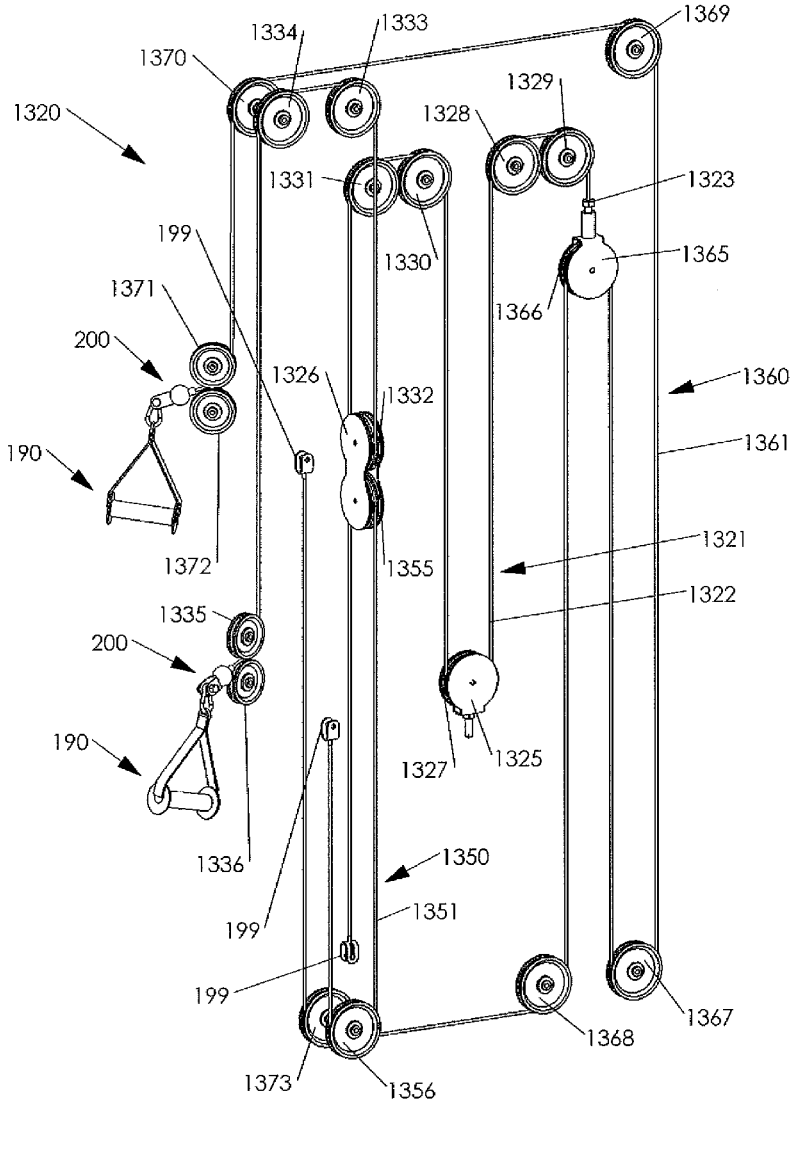
FIG. 24 is a perspective view illustrating the cable and pulley system of an alternate embodiment linearly adjustable multi resistance ratio exercise apparatus from the front left side.

In this alternate embodiment, as illustrated in FIG. 24, cable system 1320 includes cable assembly 1321, cable assembly 1350, cable assembly 1360, weight stack pulley bracket 1325, double pulley free floater 1326 and single pulley free floater 1365. Cable assembly 1321 is directly connected with the weight stack 15 and comprises cable 1322 which includes cable end assembly 200 attached at one end and cable bolt 1323 attached at the other end. Cable 1322 is routed over fixed pulleys 1329 and 1328, then downward and around pulley 1327 in weight stack pulley bracket 1325. Cable 1322 is then routed upwards and over fixed pulleys 1330 and 1331, then downwards and around pulley 1332 in double pulley free floater 1326. Cable 1322 is then routed upwards and around fixed pulleys 1333 and 1334, then downward and around linearly adjustable pulley 1335. This is where one end of cable 1322 exits a respective carriage assembly 85. Cable end assembly 200 bumpers against swivel pulley assembly 105 and provides this end of cable 1322 a rest position when not in use as well as an attachment point for handle assembly 190. Linearly adjustable pulley 1336 serves as a guide pulley when one end of cable assembly 1321 is pressed or pulled.

Cable assembly 1350 comprises cable 1351 which includes a cable end assembly 199 attached at both ends. Generally, the middle section of cable 1351 is routed around pulley 1355 in double pulley free floater 1326. Respective sides of cable 1351 are then routed downward wherein one end is coupled to the cable tie in plates 1280 on frame 1225. The other side of cable 1351 is routed around fixed pulley 1356 then upward and coupled to the same carriage assembly 85 that one end of cable 1322 is coupled to.

Cable assembly 1360 comprises cable 1361 which includes cable end assembly 200 attached at one end and cable end assembly 199 attached at the other end. Generally, the middle section of cable 1361 is routed around pulley 1366 in single pulley free floater 1365 which is coupled to one end of cable 1322. Respective sides of cable 1361 are then routed downward and around fixed pulleys 1367 and 1368. After passing fixed pulley 1367, this side of cable 1361 is then routed upward and around fixed pulley 1369, then forward and around fixed pulley 1370. Cable 1361 is then routed downward and around linearly adjustable pulley 1371. This is where one end of cable 1361 exits a respective carriage assembly 85. Cable end assembly 200 bumpers against swivel pulley assembly 105 and provides this end of cable 1361 a rest position when not in use as well as an attachment point for handle assembly 190. After passing fixed pulley 1368, the other side of cable 1361 is then routed forward and around fixed pulley 1373. Cable 1361 is then routed upward and then coupled to a respective carriage assembly 85. Cable end assembly 199 secures this end of cable 1361 into cable tie in plates 94. Both ends of cable 1361 are routed towards the same carriage assembly 85 from opposite directions therefore closing cable 1361 into a loop wherein cable assembly 1360 will maintain a substantially constant tension when respective carriage assembly 85 is linearly adjusted into the desired position. Linearly adjustable pulley 1372 serves as a guide pulley when one end of cable assembly 1361 is pressed or pulled. When one end of cable assembly 1360 is pressed or pulled, single pulley free floater 1365 is pulled downward which causes cable assembly 1360 to lift weight stack 15 therefore providing a 4 to 1 mechanical advantage to the user. Those skilled in the art will appreciate that the other end of cable 1361 could also be made to exit a swivel pulley assembly for pressing or pulling by a user rather than being tied into carriage 85.

When one end of cable assembly 1321 is pressed or pulled, double free floater 1326 and single free floater 1365 remain stationary, therefore weight stack 15 is lifted to provide a 2 to 1 mechanical advantage to the user. When the carriage assembly 85 coupled with one end of cable assembly 1321 and one end of cable assembly 1350 is linearly adjusted upward, double free floater 1326 moves downward to off set the movement of carriage assembly 85 and to enable cable system 1320 to maintain a substantially constant tension. When this carriage assembly 85 is linearly adjusted downward, double free floater 1326 moves upward to off set the movement of carriage assembly 85 and to enable cable system 1320 to maintain a substantially constant tension.

To exercise with the linearly adjustable multi resistance ratio exercise apparatus 1210, the user will select which handle assembly 190 will best suit their exercising objectives based on the amount of cable travel and the amount of resistance needed. The user will then adjust the carriage assembly 85 coupled with the selected cable end and handle assembly 190 by unlocking locking pin 95 and by relocking locking pin 95 into the desired aperture in the respective column 1260 or 1261. Based on which handle assembly 190 and mechanical advantage was selected, the user will then select the appropriate amount of resistance from weight stack 15. The user will then press or pull handle assembly 190 to perform one of many known exercises in the art. As the user exercises, the swivel pulley assembly 105 will pivot into the direction the user is pressing or pulling thus allowing smooth user defined movements. In this embodiment, if one end of cable assembly 1321 is pressed or pulled, the user will receive a 2 to 1 mechanical advantage. If one end of cable assembly 1360 is pressed or pulled, the user will receive a 4 to 1 ratio of resistance. The 4 to 1 ratio of resistance will provide less resistance and allow more cable travel which is typically needed for functional training exercises. The 2 to 1 ratio of resistance will provide more resistance for strength training movements wherein long cable travel is not required.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Also, alternate carriage assemblies and tracks could be used such as carriages that track on roller wheels or roller bearings.

Figure 26:
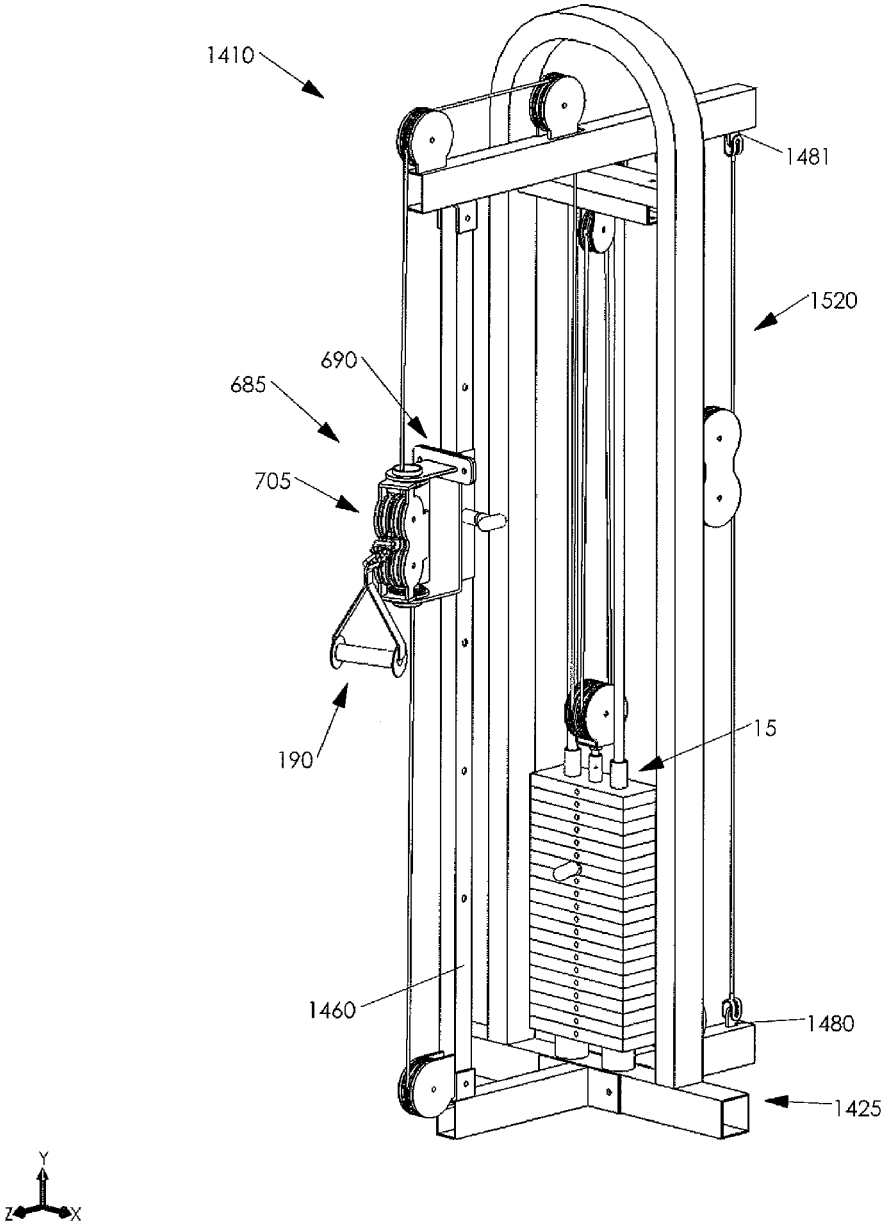
FIG. 26 is a perspective view illustrating an alternate embodiment of a linearly adjustable multi resistance ratio exercise apparatus from the front left side.
Figure 28:
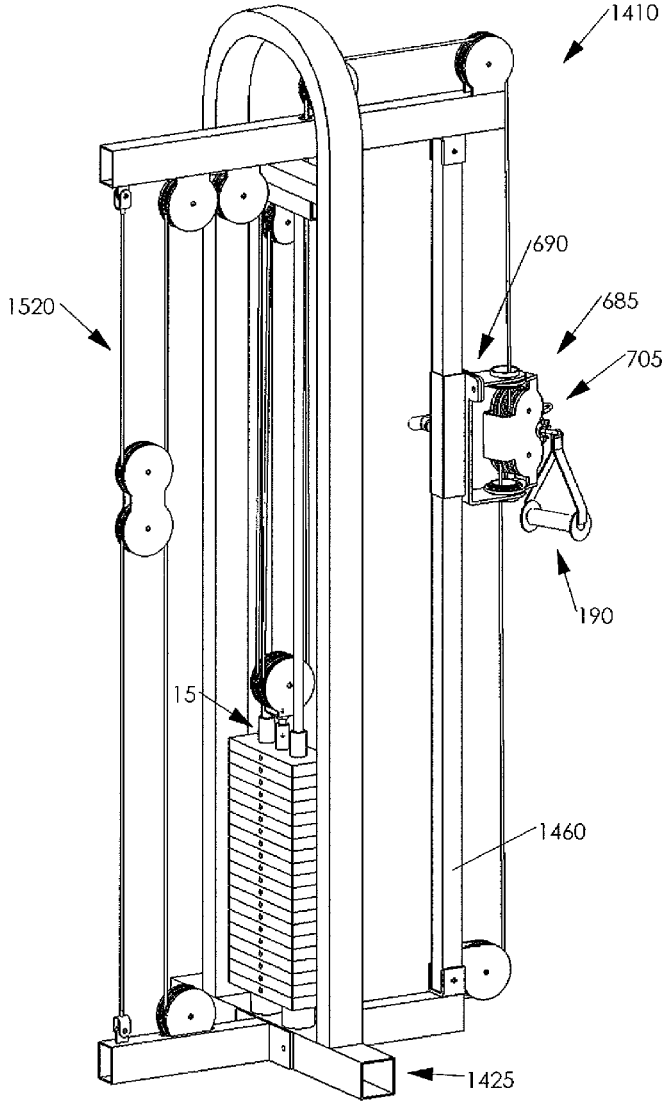
FIG. 28 is a perspective view illustrating an alternate embodiment of a linearly adjustable multi resistance ratio exercise apparatus from the back right side.
Figure 28:
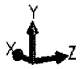

FIGS. 26 and 28 illustrate an alternate embodiment of a linearly adjustable multi resistance ratio exercise apparatus which is generally indicated by the numeral 1410 and which comprises a weight stack 15 to provide resistance, a frame 1425 to provide structural support and stability, one linearly adjustable carriage assembly 685, cable system 1520, and one handle assembly 190. FIG. 26 illustrates linearly adjustable multi resistance ratio exercise apparatus 1410 from the front wherein one linearly adjustable carriage assembly 685 is adjusted to a generally middle position along column 1460. FIG. 28 illustrates linearly adjustable multi resistance ratio exercise apparatus 1410 from the back.

The frame may have a variety of configurations depending on the specific application. In one embodiment, as shown in FIGS. 26 and 28, the frame 1425 supports weight stack 15, secures numerous pulleys within cable system 1520, and includes column 1460.

In this embodiment, the linearly adjustable multi ratio resistance exercise apparatus 1410 comprises one linearly adjustable carriage assembly 685. Linearly adjustable carriage assembly 685 comprises a sleeve assembly 690 and a swivel pulley assembly 705 and is shown in FIG. 20 and is described in detail in paragraphs 94 and 95.

Figure 27:
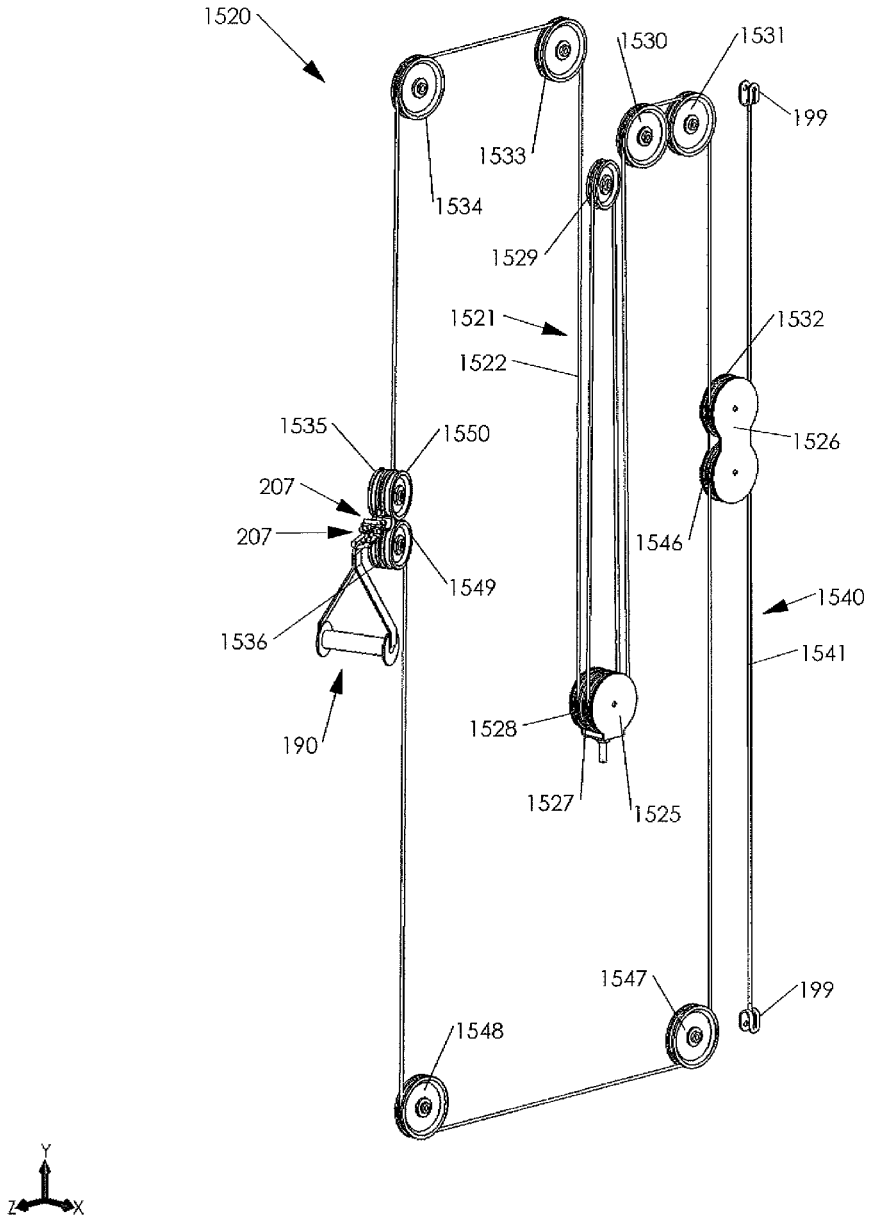
FIG. 27 is a perspective view illustrating the cable and pulley system of an alternate embodiment linearly adjustable multi resistance ratio exercise apparatus from the front left side.

In this embodiment, as illustrated in FIG. 27, cable system 1520 includes cable assembly 1521, cable assembly 1540, weight stack pulley bracket 1525, and double pulley free floater 1526.

Cable assembly 1521 is directly connected with the weight stack 15 and comprises cable 1522 which includes cable end assembly 207 attached at one end and cable end assembly 199 attached at the other end which connects cable 1522 to cable tie plate 1481. Starting at this location, cable 1522 is routed downward and around pulley 1532 in double pulley free floater 1526 then upward and around fixed pulleys 1531 and 1530. Cable 1522 is then routed downward and around pulley 1527 in weight stack pulley bracket 1525 and then upward and around fixed pulley 1529. Cable 1522 is then routed downward and around pulley 1528 in weight stack pulley bracket 1525 and then upward and around fixed pulleys 1533 and 1534. Cable 1522 is then routed downward and around linearly adjustable pulley 1535. This is where one end of cable 1522 exits carriage assembly 685. Cable end assembly 207 bumpers against swivel pulley assembly 705 and provides this end of cable 1522 a rest position when not in use as well as an attachment point for handle assembly 190. Linearly adjustable pulley 1536 serves as a guide pulley when this end of cable 1522 is pressed or pulled.

Cable assembly 1540 comprises cable 1541 which includes a cable end assembly 207 attached at one end and a cable end assembly 199 attached at the other end. Generally, the middle section of cable 1541 is routed around pulley 1546 in double pulley free floater 1526. One side of cable 1541 is then routed downward wherein cable end assembly 199 ties into cable tie in plate 1480. The other side of cable 1541 is then routed downward and around fixed pulley 1547, then forward and around fixed pulley 1548. Cable 1541 is then routed upward and around linearly adjustable pulley 1549. This is where one end of cable assembly 1540 exits carriage assembly 685. Cable end assembly 207 bumpers against swivel pulley assembly 705 and provides this end of cable 1541 a rest position when not in use as well as an attachment point for handle assembly 190. Linearly adjustable pulley 1550 serves as a guide pulley when this end of cable 1541 is pressed or pulled.

When the end of cable assembly 1521 wherein cable end assembly 207 is attached is pressed or pulled, double free floater 1526 remains stationary therefore weight stack 15 is lifted to provide a 4 to 1 ratio of resistance. When the end of cable assembly 1540 wherein cable end assembly 207 is attached is pressed or pulled, double free floater 1526 is pulled downward which causes weight stack 15 to lift upward therefore providing a 4 to 1 ratio of resistance. When each end of cable assembly 1521 and cable assembly 1540 wherein cable end assemblies 207 are attached are pulled together at the same time, double free floater 1526 is pulled downward and cable 1521 on both sides of pulleys 1527 and 1528 in weight stack pulley bracket 1525 lift weight stack 15 to provide a 2 to 1 ratio of resistance.

When carriage assembly 685 is linearly adjusted upward, double free floater 1526 moves downward to off set the movement of carriage assembly 685 and to enable cable system 1520 to maintain a substantially constant tension. When carriage assembly 85 is linearly adjusted downward, double free floater 1526 moves upward to off set the movement of carriage assembly 685 and to enable cable system 1520 to maintain a substantially constant tension.

To exercise with the linearly adjustable multi resistance ratio exercise apparatus 1410, the user can select between pressing or pulling one end of cable assembly 1521 or one end of cable assembly 1540 individually to obtain a 4 to 1 ratio of resistance, or by pressing or pulling both ends at the same time by connecting both ends to one handle assembly 190 to obtain a 2 to 1 ratio of resistance. By pressing or pulling one end of cable assembly 1521 less resistance will be provided and more cable end travel will be available for functional training exercises. By pressing or pulling one end of cable assembly 1540 less resistance will be provided however double free floater 1526 will travel downward when this end is pulled and will limit the cable end travel. By pressing or pulling both ends at the same time with one handle assembly 190, more resistance will be provided for strength training movements wherein long cable end travel is not needed. Since one end of cable assembly 1521 and one end of cable assembly 1540 exit the same swivel pulley assembly 705, they are close enough to one another to connect to one handle assembly 190 as illustrated in FIG. 21. Also, because both cable ends exit the same swivel pulley assembly 705, swivel pulley assembly 705 will pivot in the direction the user presses or pulls both ends along with handle assembly 190.

The user can adjust carriage assembly 685 by unlocking locking pin 692 and by relocking locking pin 692 into the desired aperture in column 1460. Based on whether the user has chosen to pull one end of cable assembly 1521 or one end of cable assembly 1541, or both ends at the same time, the user will then select the appropriate amount of resistance from weight stack 15. The user will then press or pull handle assembly 190 to perform one of many known exercises in the art.

Those skilled in the art will appreciate that modifications to this embodiment can be made without departing from the scope of the invention. An alternate frame configuration could be used. Different ratios of resistance other than those shown can be used. An alternate configuration of cables and pulleys could be used. More cable assemblies could be used to tap into the main cable sector to provide additional cable ends that exit a carriage assembly. Also, alternate carriage assemblies and tracks could be used such as carriages that track on roller wheels or roller bearings.

Also, those skilled in the art will appreciate that some aspects of some of the above mentioned embodiments can be combined within one another. The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An exercise apparatus comprising:

a frame, said frame including or connected with at least one linear track;

a resistance element to provide resistance for performing exercise;

at least two carriage assemblies linearly adjustable along a respective said linear track, each said carriage assembly including at least one pulley;

a flexible connector system coupled to said resistance element and comprising two or more flexible lines, said flexible connector system including a first flexible line end and a second flexible line end coupled to a first said carriage assembly, a third flexible line end and a fourth flexible line end coupled to a second said carriage assembly, said first and third flexible line ends partially wrapping around and extending beyond respective said pulleys and maintaining respective rest positions until pulled;

at least one handle; and wherein said flexible connector system is configured to provide a first ratio of resistance when a respective said handle is attached to said first flexible line end and pulled by a user, and to provide a second ratio of resistance different and greater than said first ratio of resistance when a respective said handle is attached to said third flexible line end and pulled by said user, said first flexible line end and said third flexible line end being linearly adjustable to multiple positions along a respective said linear track.

2. The exercise apparatus of claim 1 further comprising at least two swivel pulley assemblies, each said swivel pulley assembly including at least one said pulley, each said swivel pulley assembly pivotally mounted to a respective said carriage assembly wherein each respective said swivel pulley assembly pivots in the direction said first and third flexible line ends are pulled during exercise.

3. The exercise apparatus of claim 1 wherein a first said flexible line includes said first flexible line end, a second said flexible line includes said third flexible line end, and a third said flexible line includes said fourth flexible line end.

4. The exercise apparatus of claim 3 wherein said first flexible line includes said second flexible line end.

5. The exercise apparatus of claim 3 wherein said second flexible line and said third flexible line are coupled together by a free floater unit comprising at least two pulleys that moves in an opposite linear direction of said second carriage assembly when said second carriage assembly is linearly adjusted.

6. The exercise apparatus of claim 1 wherein said first flexible line end has at least one foot more travel distance capability when pulled to the maximum distance allowed by said exercise apparatus than said third flexible line end when pulled to the maximum distance allowed by said exercise apparatus.

7. The exercise apparatus of claim 1 wherein said at least one handle is one handle assembly for selectively coupling to either said first or said third flexible line end.

8. An exercise apparatus comprising:

a frame, said frame including or connected with a linear track;

a resistance element to provide resistance for performing exercise;

a carriage assembly linearly adjustable along said linear track, said carriage assembly including at least two pulleys;

a flexible connector system coupled to said resistance element and comprising two or more flexible lines, said flexible connector system including a first, second, third, and fourth flexible line end coupled to said carriage assembly, said first and third flexible line ends partially wrapping around and extending beyond respective said pulleys and maintaining respective rest positions until pulled;

at least one handle; and wherein said flexible connector system is configured to provide a first ratio of resistance when a respective said handle is attached to said first flexible line end and pulled by a user, and to provide a second ratio of resistance different and greater than said first ratio of resistance when a respective said handle is attached to said third flexible line end and pulled by said user, said first flexible line end and said third flexible line end being linearly adjustable to multiple positions along said linear track.

9. The exercise apparatus of claim 8 further comprising at least two swivel pulley assemblies, each said swivel pulley assembly including at least one said pulley, each said swivel pulley assembly pivotally mounted to said carriage assembly wherein each respective said swivel pulley assembly pivots in the direction said first and third flexible line ends are pulled during exercise.

10. The exercise apparatus of claim 8 wherein a first said flexible line includes said first flexible line end, a second said flexible line includes said third flexible line end, and a third said flexible line includes said fourth flexible line end.

11. The exercise apparatus of claim 10 wherein said first flexible line includes said second flexible line end.

12. The exercise apparatus of claim 10 wherein said second flexible line and said third flexible line are coupled together by a free floater unit comprising at least two pulleys that moves in an opposite linear direction of said carriage assembly when said carriage assembly is linearly adjusted.

13. The exercise apparatus of claim 8 wherein said first flexible line end has at least one foot more travel distance capability when pulled to the maximum distance allowed by said exercise apparatus than said third flexible line end when pulled to the maximum distance allowed by said exercise apparatus.

14. The exercise apparatus of claim 8 further comprising a swivel pulley assembly, said swivel pulley assembly including at least two said pulleys, said swivel pulley assembly pivotally mounted to said carriage assembly wherein said swivel pulley assembly pivots in the direction said first and third flexible line ends are pulled during exercise.

15. The exercise apparatus of claim 8 wherein said at least one handle is one handle assembly for selectively coupling to either said first or said third flexible line end.

16. An exercise apparatus comprising:

a frame, said frame including or connected with a linear track;

a resistance element to provide resistance for performing exercise;

a carriage assembly linearly adjustable along said linear track;

a swivel pulley assembly including at least two pulleys, said swivel pulley assembly pivotally mounted to said carriage assembly;

a flexible connector system coupled to said resistance element and comprising two or more flexible lines, said flexible connector system including a first and a second flexible line end coupled to said carriage assembly, said first and second flexible line ends partially wrapping around and extending beyond respective said pulleys and maintaining respective rest positions until pulled;

a handle assembly, including a handle, configured to connect to one or both of said first and second flexible line ends;

wherein said flexible connector system provides a first ratio of resistance when said handle is connected to one of said first and second flexible line ends and pulled; and wherein said flexible connector system provides a second ratio of resistance greater than said first ratio of resistance when said handle is connected to both of said first and second flexible line ends and pulled.

17. The exercise apparatus of claim 16 wherein a first said flexible line includes said first flexible line end and a second said flexible line includes said second flexible line end.

18. The exercise apparatus of claim 17 wherein said first flexible line and said second flexible line are coupled together by a free floater unit comprising at least two pulleys that moves in an opposite linear direction of said carriage assembly when said carriage assembly is linearly adjusted.

19. The exercise apparatus of claim 16 wherein said first and second flexible line ends comprise opposing ends of a first cable forming a closed loop.

* * * * *